US009057200B2

(12) United States Patent
Putnam

(10) Patent No.: US 9,057,200 B2
(45) Date of Patent: Jun. 16, 2015

(54) PATIO, PORCH OR WALKWAY ASSEMBLY INCORPORATING A PLURALITY OF BLOCKS AND INCLUDING ANY COMBINATION OF PRE-CAST AND EXPOSED SURFACED PATTERNS, INTERIORLY SUPPORTED HEATING PADS AND LED EFFECT LIGHTING

(71) Applicant: Kevin Putnam, Imlay City, MI (US)

(72) Inventor: Kevin Putnam, Imlay City, MI (US)

( * ) Notice: Subject to any disclaimer, the term of this patent is extended or adjusted under 35 U.S.C. 154(b) by 0 days.

(21) Appl. No.: 14/095,280

(22) Filed: Dec. 3, 2013

(65) Prior Publication Data

US 2014/0157691 A1 Jun. 12, 2014

Related U.S. Application Data

(60) Provisional application No. 61/734,044, filed on Dec. 6, 2012.

(51) Int. Cl.

| | |
|---|---|
| ***E04B 1/00*** | (2006.01) |
| ***E04F 11/116*** | (2006.01) |
| ***E04F 11/17*** | (2006.01) |
| ***E01C 11/26*** | (2006.01) |
| ***E01C 15/00*** | (2006.01) |
| *E04F 11/104* | (2006.01) |

(52) U.S. Cl.

CPC ..... *E04F 11/116* (2013.01); *E04F 11/17* (2013.01); *E04F 2011/1048* (2013.01); *E01C 11/265* (2013.01); *E01C 15/00* (2013.01)

(58) Field of Classification Search

CPC ..... E04F 11/11; E04F 11/17; E01C 11/2656
USPC ..... 52/169.1, 405.2, 406.1, 309.15, 309.17, 52/503

See application file for complete search history.

(56) References Cited

U.S. PATENT DOCUMENTS

| | | | | | |
|---|---|---|---|---|---|
| 3,412,502 | A | * | 11/1968 | Riches | 446/69 |
| 3,440,788 | A | * | 4/1969 | Merget | 52/405.2 |
| 3,593,480 | A | * | 7/1971 | Bouchillon | 52/415 |
| 3,665,669 | A | * | 5/1972 | Huber | 52/592.3 |
| 3,668,832 | A | * | 6/1972 | Harman | 52/591.2 |
| 4,490,075 | A | | 12/1984 | Risi et al. | |
| 4,766,711 | A | * | 8/1988 | Bermingham et al. | 52/404.1 |
| 4,820,079 | A | * | 4/1989 | Wheeler | 405/23 |

(Continued)

OTHER PUBLICATIONS

EZ Step Custom Stone Works data Sheets, 2 pages, Jan. 1954.

(Continued)

*Primary Examiner* — Basil Katcheves

(74) *Attorney, Agent, or Firm* — Gifford, Krass, Sprinkle, Anderson & Citkowski, P.C.; Douglas J. McEvoy

(57) ABSTRACT

An assembly for creating a three dimensional exterior structure incorporates a plurality of bodies inter-assembled via engaging tongue and groove profiles to create at least one of a multi-tier stepped or extending walkway surface. Each of the bodies further exhibits a hollowed interior to facilitate in-filling of a compactible material in order to weight said bodies during assembly. Either or both of thermal generating elements or effect lighting can be incorporated into one or more of the bodies. The bodies can also include tiered or stackable step blocks, each exhibiting an interior ledge for supporting a thermally conducting insert shelf or pad, additional rectangular assembled blocks providing tongue and groove engagement and supporting the underside of the step blocks.

11 Claims, 33 Drawing Sheets

(56) References Cited

U.S. PATENT DOCUMENTS

| | | | | | |
|---|---|---|---|---|---|
| 4,914,876 | A * | 4/1990 | Forsberg | 405/286 |
| 5,062,244 | A | 11/1991 | Ducharme | |
| 5,107,653 | A * | 4/1992 | Lewis | 52/591.1 |
| 5,129,756 | A * | 7/1992 | Wheeler | 405/23 |
| 5,230,195 | A * | 7/1993 | Sease | 52/592.6 |
| 5,429,340 | A | 7/1995 | Young et al. | |
| 5,471,808 | A * | 12/1995 | De Pieri et al. | 52/603 |
| 5,535,568 | A * | 7/1996 | Quinn | 52/608 |
| 5,614,292 | A | 3/1997 | Saylor | |
| 5,622,456 | A | 4/1997 | Risi et al. | |
| 5,832,687 | A * | 11/1998 | Willemsen | 52/592.6 |
| 6,354,714 | B1 * | 3/2002 | Rhodes | 362/153.1 |
| 6,394,705 | B1 * | 5/2002 | Lefebvre | 405/262 |
| D470,196 | S * | 2/2003 | Sorensen | D21/499 |
| 6,943,320 | B1 | 9/2005 | Bavett | |
| 7,341,685 | B2 | 3/2008 | Hamilton et al. | |
| 8,448,403 | B1 * | 5/2013 | Wallace | 52/607 |
| 2001/0019684 | A1 | 9/2001 | Manthei et al. | |
| 2002/0069595 | A1 * | 6/2002 | Knudson et al. | 52/102 |
| 2003/0080040 | A1 * | 5/2003 | Savage et al. | 210/292 |
| 2005/0005556 | A1 | 1/2005 | Collier et al. | |
| 2006/0254947 | A1 * | 11/2006 | Rogers | 206/509 |
| 2011/0185662 | A1 | 8/2011 | Mollinger et al. | |
| 2011/0211918 | A1 | 9/2011 | Johnson et al. | |
| 2011/0265399 | A1 | 11/2011 | Hahn | |
| 2011/0296792 | A1 | 12/2011 | Raboine | |

OTHER PUBLICATIONS

US 6,089,793, 07/2000, Rainey (withdrawn)

* cited by examiner

FIG. 45
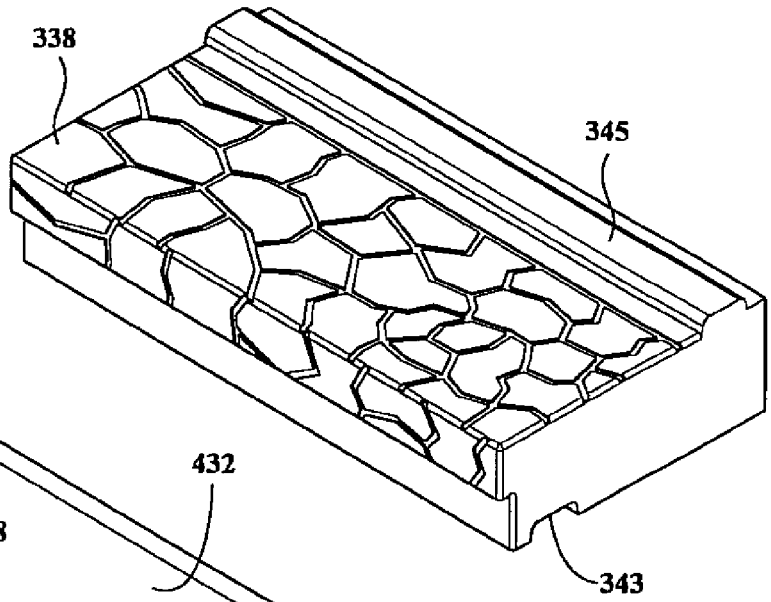
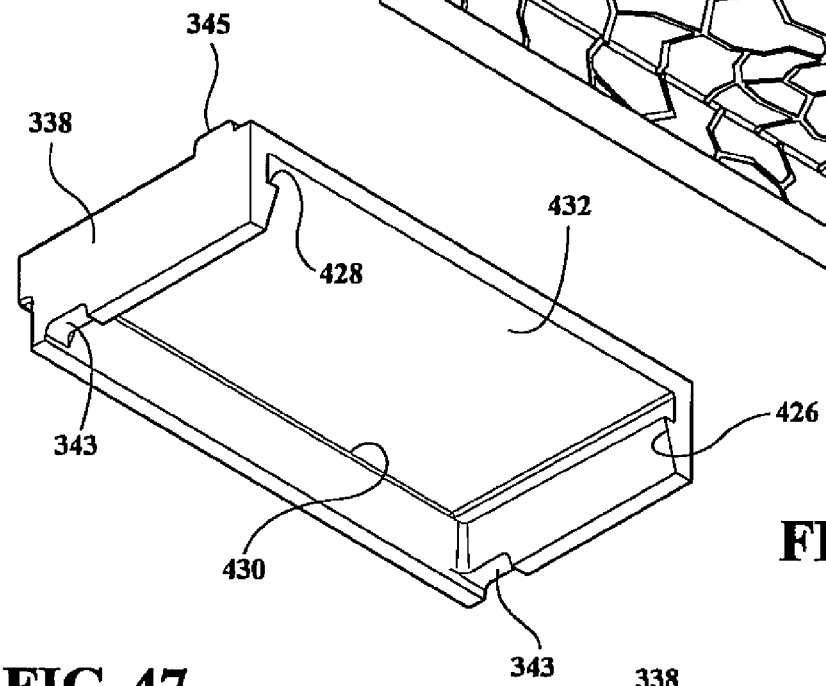
FIG. 46
FIG. 47
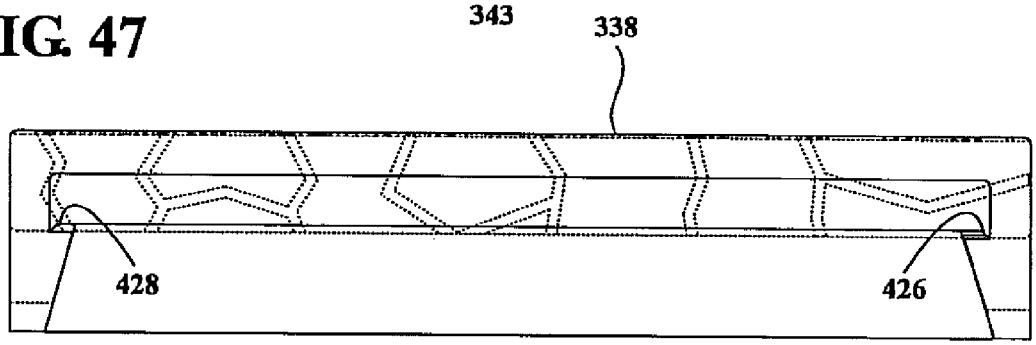
FIG. 48
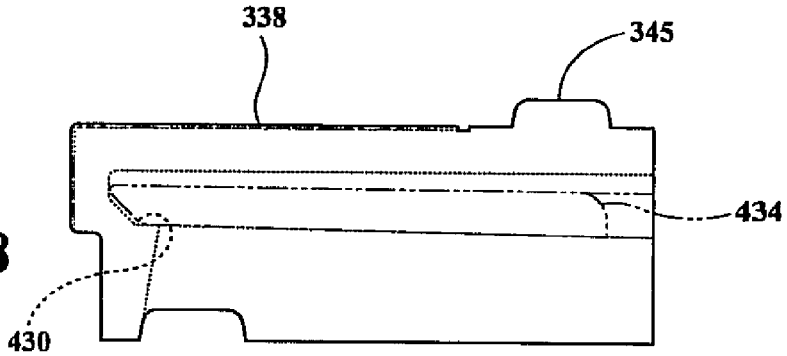

FIG. 49
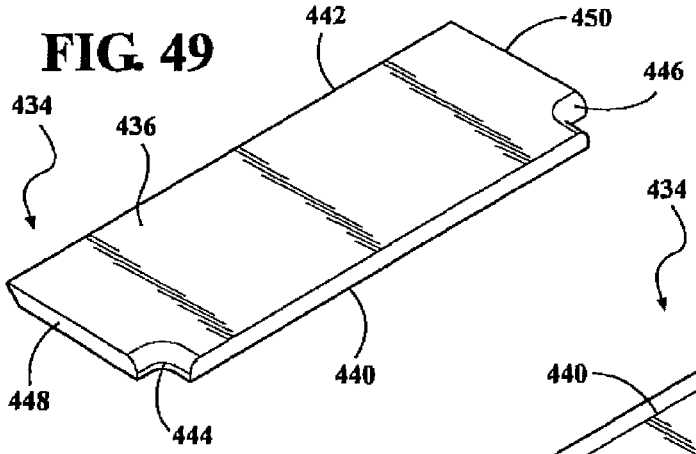
FIG. 50
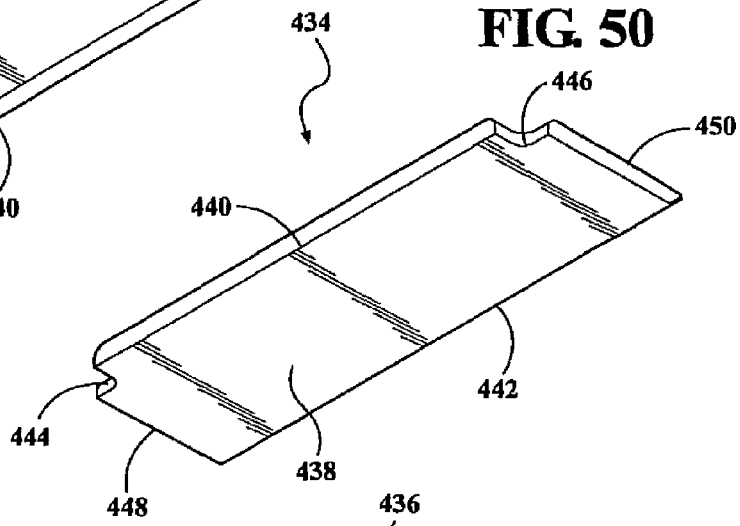
FIG. 51
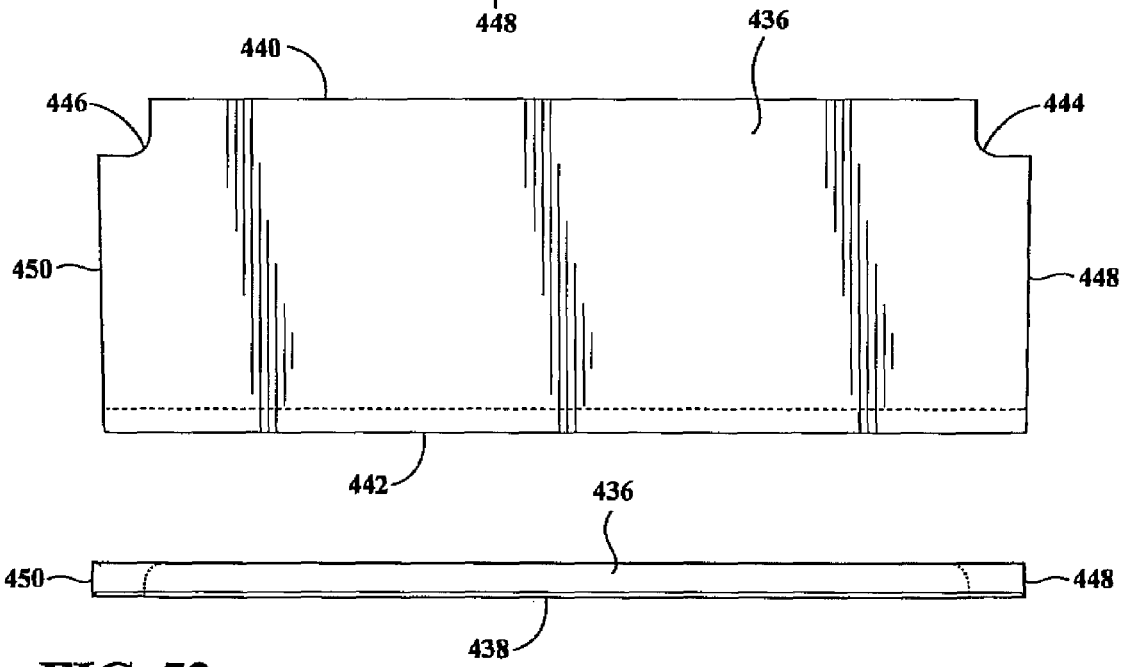
FIG. 52
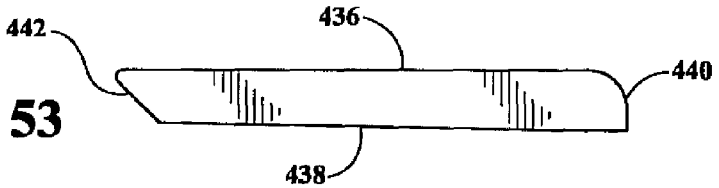
FIG. 53

PATIO, PORCH OR WALKWAY ASSEMBLY INCORPORATING A PLURALITY OF BLOCKS AND INCLUDING ANY COMBINATION OF PRE-CAST AND EXPOSED SURFACED PATTERNS, INTERIORLY SUPPORTED HEATING PADS AND LED EFFECT LIGHTING

CROSS-REFERENCE TO RELATED APPLICATIONS

This Application claims the benefit of U.S. Provisional Application 61/734,044 filed on Dec. 6, 2012, the contents of which are incorporated herein in its entirety.

FIELD OF THE INVENTION

The present application discloses a variety of kits, assemblies incorporating pre-cast and modular blocks of material (including any of a lightweight composite concrete material as well as any type of polymeric or composite materials). The blocks can be designed so as to exhibit a suitable configuration enabling them to be assembled into a multi-step exterior construction, such as associated with any of a stairway, porch, patio or walkway surface. Specific advantages associated with the present designs include the ability to easily and rapidly reconfigure the blocks, utilizing a tongue and groove arrangement, for facilitating rapid assembly.

Exposed surfaces of the blocks can be precast with any desired pattern or decorative surface/texturing during their initial manufacture, thus avoiding the necessity of stamping on site in a semi-cured state. Additional features include the provision of heating pads or interior filaments, these being installed within surface located blocks in order to facilitate melt off of snow or ice.

Other variants contemplate the heating pads being integrated, this including being replaceable, into a planar shaped body which can in turn define a recess defining shelf or tier exhibiting a ledge within which the pad can be installed. Stackable support blocks, such as exhibiting a tongue and groove arrangement, are assembled in an initial tier at an earthen grade location and which are stacked in order to provide support for the tier defining shelves.

Additional effects lighting, such as LED (light emitting diode) elements can be installed within the interior architecture of the blocks, and such the lights are visible through at least vertical extending step surfaces. Other features include the provision of underside recesses associated with each of the individual blocks or shelves for receiving gravel or the like (such as which are filled during successive stacking of the blocks into levels or tiers), as well as drainage or run-off channels.

Other features includes the provision of an extending walkway surface, such as associated with the steps and/or porch, and which can likewise integrate any combination of heating pads, lighting or other accessories in order to provide the desired feature and functionality to the assembly. Throughout the several variants disclosed, the exterior surfaces of the shelves or patio blocks can exhibit any precast or subsequently stamped pattern or texturing in order to establish a desired decorative design.

BACKGROUND OF THE INVENTION

The prior art is documented with examples of steps, patio and walkway assemblies, such as which can be constructed from arrangements of concrete pre-cast blocks. Disadvantages of existing assemblies include both the shipping and transport weight of the blocks, combined with the limitations as to feature and functionality with which the blocks can be reconfigured or accessorized.

Reference is also made to the heating system for use on or in a driveway, roadway, walkway, patio, deck or stairs as disclosed in U.S. Pat. No. 6,943,320 to Bavett. Other examples drawn from the prior art include the thermal walkway cover with laminated layers of carbonized rubber (U.S. Pat. No. 5,614,292 to Saylor) and the composite building block having moisture barrier and insulation element disclosed in Collier (US Patent Application Publication 2005/0005556). Other and additional retaining wall systems include each of the modular earth system of Rainey, U.S. Pat. No. 6,089,793, and the interlocking block and retaining wall system of Risi et al., U.S. Pat. No. 4,490,075.

SUMMARY OF THE INVENTION

The present invention discloses a variety of kits and assemblies for creating any of a porch, patio, step or walkway surface, such incorporating a variety of pre-cast components which can be stacked or otherwise assembled as well as reconfigured in any fashion in order to create a visually appealing construction at reasonable cost and with high efficiency. The individual components can include any silicate based (e.g. concrete) or other material which may be a composite of a silicate with foam or other polymeric filler components, and which are shaped or otherwise formed in a mold in order to create a three dimensional shape.

The mold which creates the individual components, also termed step blocks and under supporting blocks, can exhibit any desired surface pattern or texturing in order to provide a desired decorative appearance. Alternatively, the invention contemplates a subsequent roughing, texturing or other imprinting step performed on pre casted blocks in order to achieve a desired patterning or design.

The configuration of the blocks can exhibit comprising a plurality of individual prefabricated elements arranged in either of a side-by-side or vertically stacked fashion in order to create a desired structure. In one application, pluralities of blocks define each of succeeding layers and which are stacked via tongue and groove profiles, with a top pad resting upon an upper most plurality of blocks.

The blocks can each further exhibit at least one recessed cavity far receiving a volume of a gravel, pea stone or other ballasting or compact-able material (these often available in natural form on-site or otherwise easily transported), the advantage of which being that such natural loose fill materials provide the necessary anchoring and weighting to the interiorly recessed volume established by the blocks or shelves. In this fashion, the blocks can be produced and shipped at a lighter weight than is associated with standard concrete blocks, thereby saving in transport cost.

The individual blocks can each exhibit a one-piece construction with an outer bull nose configuration. Heat generating elements can be installed within the individual elements and can include any of electrical resistant generating pads or fluid conduit conveying systems extending through and between the prefabricated elements or sections. Other features include effect lighting installed within any one or more of the prefabricated sections, these including in one construction individual LED elements mounted within aperture locations defined in vertical riser locations of each layer of blocks (or possibly in other locations including horizontally arrayed and as associated with any other type of porch, patio, step or walkway surface).

A further variant of an assembleable kit includes a multi-tier assembly in which a heat generating shelf or insert is provided in installed fashion within any one or more of a plurality of blocks arranged in any stacked or tiered fashion. An electrical or fluid heating pad is capable of being installed within an underside ledge associated with a recessed interior of each shelf variant of tiered heating shelves or jackets, with the pads capable of being daisy-chained together to feed electricity or heated fluid from a single input location.

A plurality of three dimensional shaped and tongue and groove inter-assembleable support blocks are provided, an initial layer of which is assembled upon and into the earth or ground location in order to array a top extending surface thereof level or flush to a grade surface. Additional support blocks are stacked in order to provide tiered support for the step blocks which are installed in stepped fashion, with associated walkway surface also depicts apertures for receiving heating elements to facilitate the melting of snow and ice;

BRIEF DESCRIPTION OF THE DRAWINGS

Reference will now be made to the attached drawings, when read in combination with the following detailed description, wherein like reference numerals refer to like parts throughout the several views, and in which:

FIG. 45 is a sectional perspective of a selected tier defining step block illustrating a top decorative surface;

FIG. 46 is a rotated underside perspective of the step block in FIG. 45 illustrating its recess construction and underside ledge for supporting an inserted heating pad;

FIG. 47 is an end plan view of the shelf of FIGS. 45 and exhibiting the exterior decorative pattern in phantom;

FIG. 48 is a side plan view of the shelf of FIG. 45 and disclosing in phantom the inner pad supporting profile with inside forward ledge communicating with interconnecting side ledges shown in FIGS. 46-47 in order to secure the heat generating shelf;

FIG. 49 is a perspective illustration of a heat generating shelf according to one non-limiting configuration;

FIG. 50 is a rotated underside perspective of the heating shelf shown in FIG. 49;

FIG. 51 is a top plan view illustrating in phantom the undercut angled forward underside edge of the shelf;

FIG. 52 is a front plan view of the shelf of FIG. 49 and depicting in phantom the rear inserting edge of the pad; and FIG. 53 is a side profile view of the shelf of FIG. 49.

DETAILED DESCRIPTION OF THE PREFERRED EMBODIMENTS

With reference to the following illustrations and description, the present application discloses a variety of kits and assemblies incorporating pre-cast and modular blocks of material (including any of a lightweight composite concrete material as well as any type of polymeric or composite materials). As will be described in further detail, the blocks exhibit a suitable configuration enabling them to be assembled into a multi-step exterior construction, such as associated with any of a stairway, porch, patio or walkway surface.

Additional advantages of the kit, assembly and methods described herein further include the lightweight construction of the precast blocks permitting an individual (or pair of individuals) to quickly and fairly effortlessly assemble the lightweight and precast blocks into a desired configuration, such assisted by the use of compactible aggregate or like material which is often available on site and which provides the necessary weighting and ballasting aspects which are typical of heavier pre-cast block constructions. Unlimited variations of the kit, assembly and method also contemplate the ability to quickly assemble the (lightweight) blocks, usually without the need to mix cement or to otherwise cut or section the blocks.

As also previously noted, specific advantages associated with the present designs include the ability to easily and rapidly reconfigure the blocks, these incorporating interlocking tongue and groove arrangements extending along both horizontal and vertical exterior surfaces, for facilitating rapid assembly. Exposed surfaces of the blocks can be precast with exposed patterns during their initial manufacture, thus avoiding the necessity of stamping on site in a semi-cured state.

Additional features include the provision of heating pads or interior filaments, these being installed within surface located blocks in order to facilitate melt off of snow or ice. As will be also described, other options for facilitating snow/ice melt-off include utilization of solar, geothermal and other heat conducting properties, such as incorporated into a water/glycol or other heat convecting fluid which can be pumped through lines extending within the assembled block structure.

Additional effects lighting, such as LED (light emitting diode) elements can be installed within the interior architecture of the blocks, and such the lights are visible through at least vertical extending step surfaces. Other features include the provision of underside recesses for receiving gravel, pea stone or other compactible and loose fill materials (such as which are filled during successive stacking of the blocks into levels or tiers), as well as drainage or run-off channels.

Figure 1:
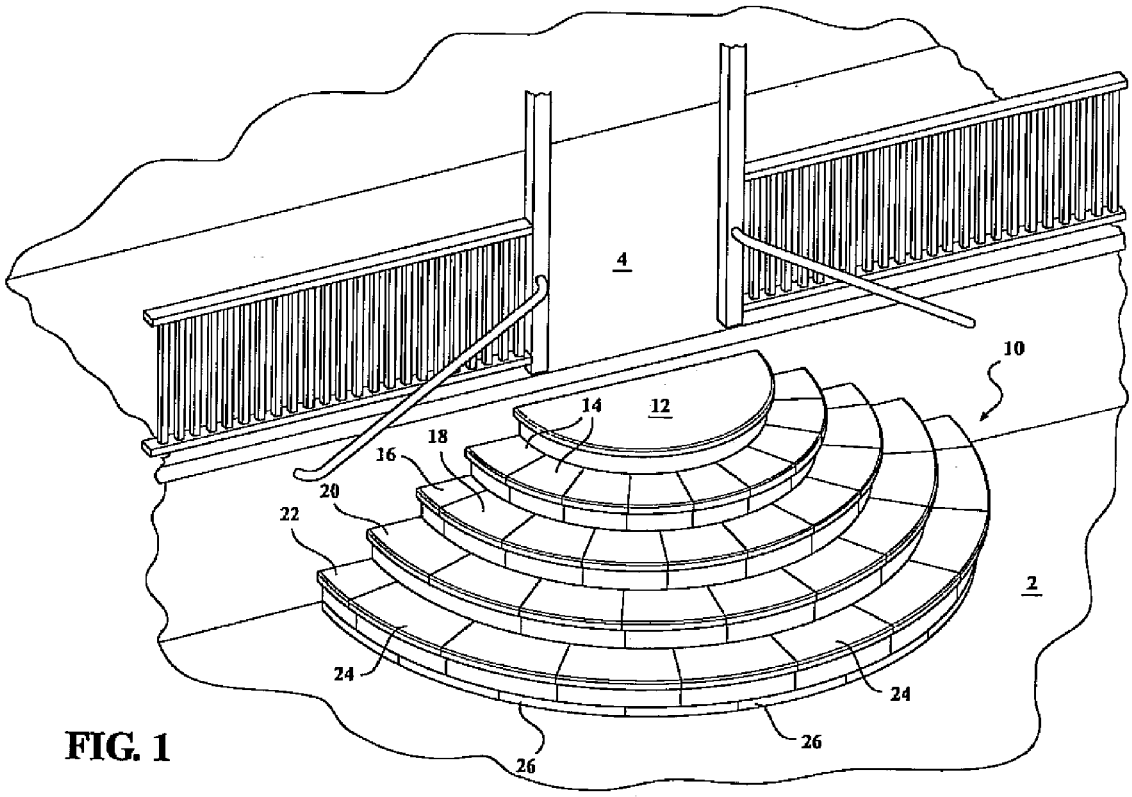
FIG. 1 is an environmental perspective of a multi-tier step assembly incorporating the pre-cast and reconfigurable block structures according to one non-limiting embodiment of the present invention.

With reference to the illustrations, and initially to FIG. 1, an environmental perspective, generally at 10, is shown of a multi-tier step assembly in a half-round configuration and incorporating the pre-cast and reconfigurable block structures according to one non-limiting embodiment of the present invention and which is depicted defining a plurality of ascending steps from a ground (turf) location 2 to an elevated porch 4 or other like surface associated with a structure. As will be further described in succeeding views FIGS. 2-20, the pre-cast blocks associated with this initially depicted variant can be constructed of any material not limited to a lightweight concrete composite, and can also include any heavy duty polymer or other suitable material.

As will be further described in reference to the succeeding depictions, the assembly 10 can include a number of stacked levels depicted in any arrangement or configuration. As further shown, this can include each of a top most located (and typically one piece) pad 12, a second tier or level exhibiting a plurality of formed blocks 14, a third level optionally including a pair of opposite end-most depicted blocks (e.g. at 16) along with an intermediate aligning arrangement of blocks 18, a fourth level of end-to-end aligned blocks 20, a fifth level of blocks again including a pair of opposite end-most blocks 22 and intermediate aligning blocks 24, as well as a base, below grade plurality of subterranean blocks 26. Without limitation, the steps will be residential building code compliant (per rise, tread and landing length before an entry door). In particular, the landing area length, in walking direction, of a top surface must be at a minimum thirty six inches long when flush to an entry door floor height. Industry standard hand railing can be attached when necessary (see again FIG. 1).

Figure 2:
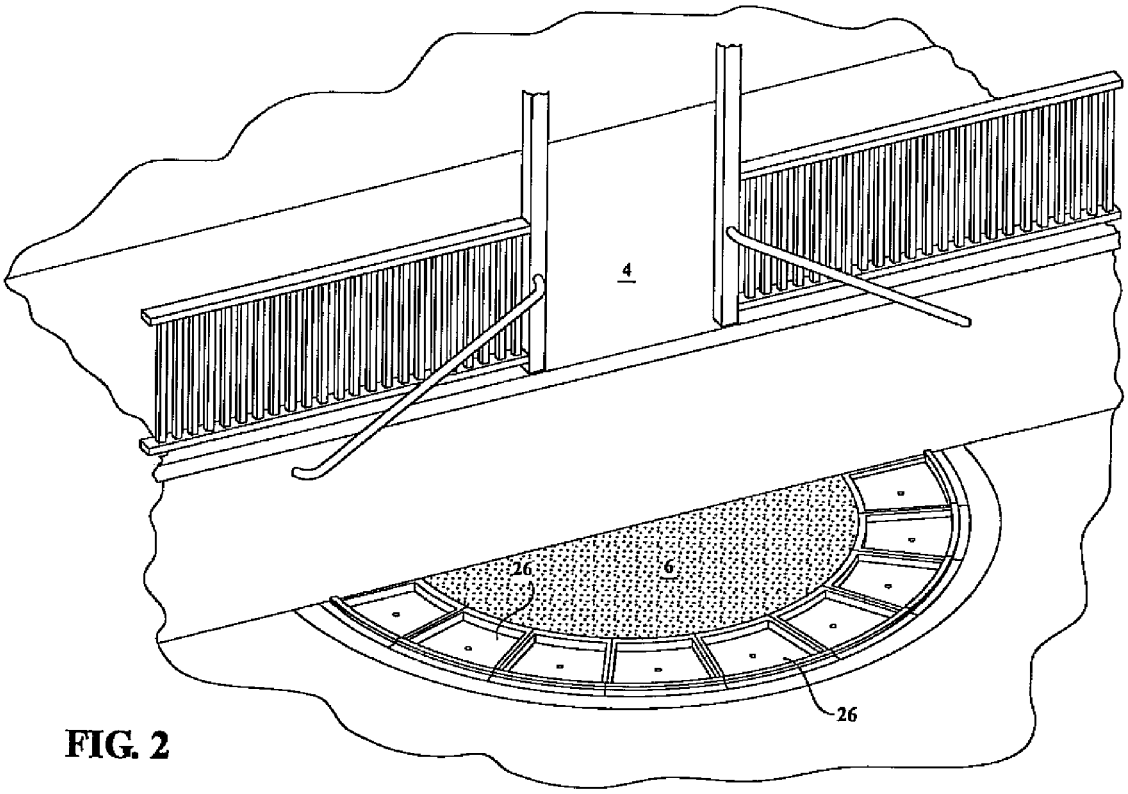
FIG. 2 depicts an initial tier of configured blocks in the assembly of FIG. 1, such as supported upon compactible gravel during emplacement.
Figure 3:
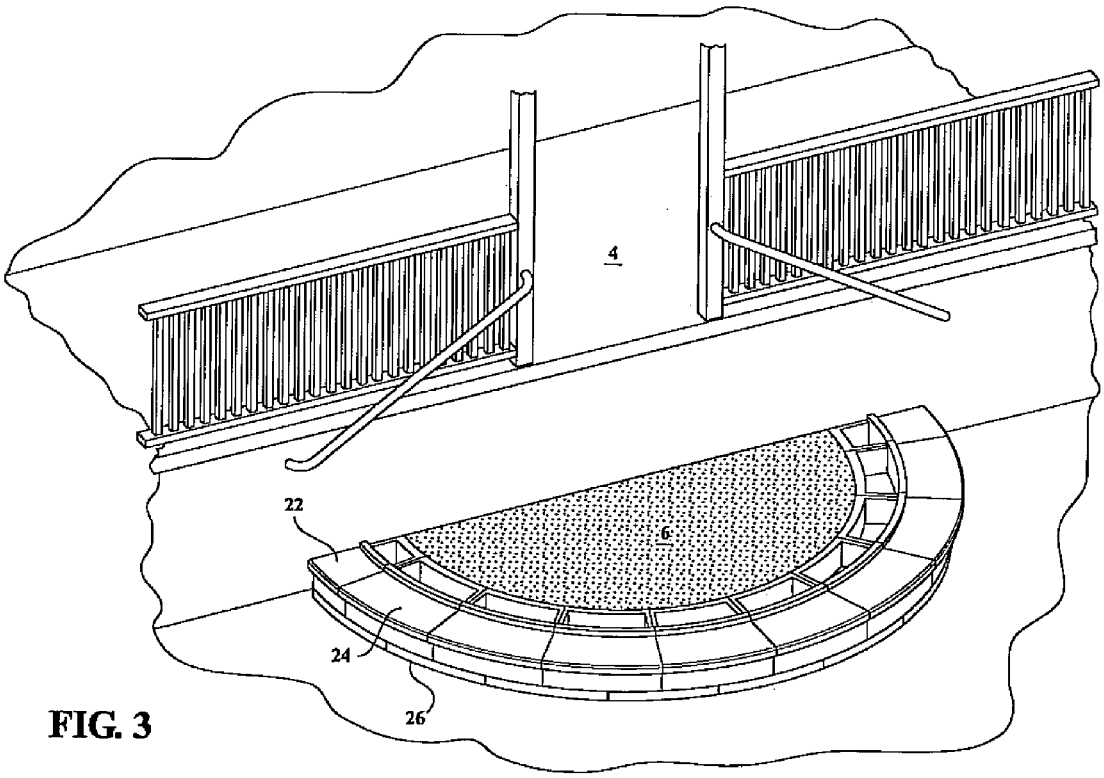
FIG. 3 is a succeeding illustration of a second tier of block supported upon the first ground biased tier.
Figure 4:
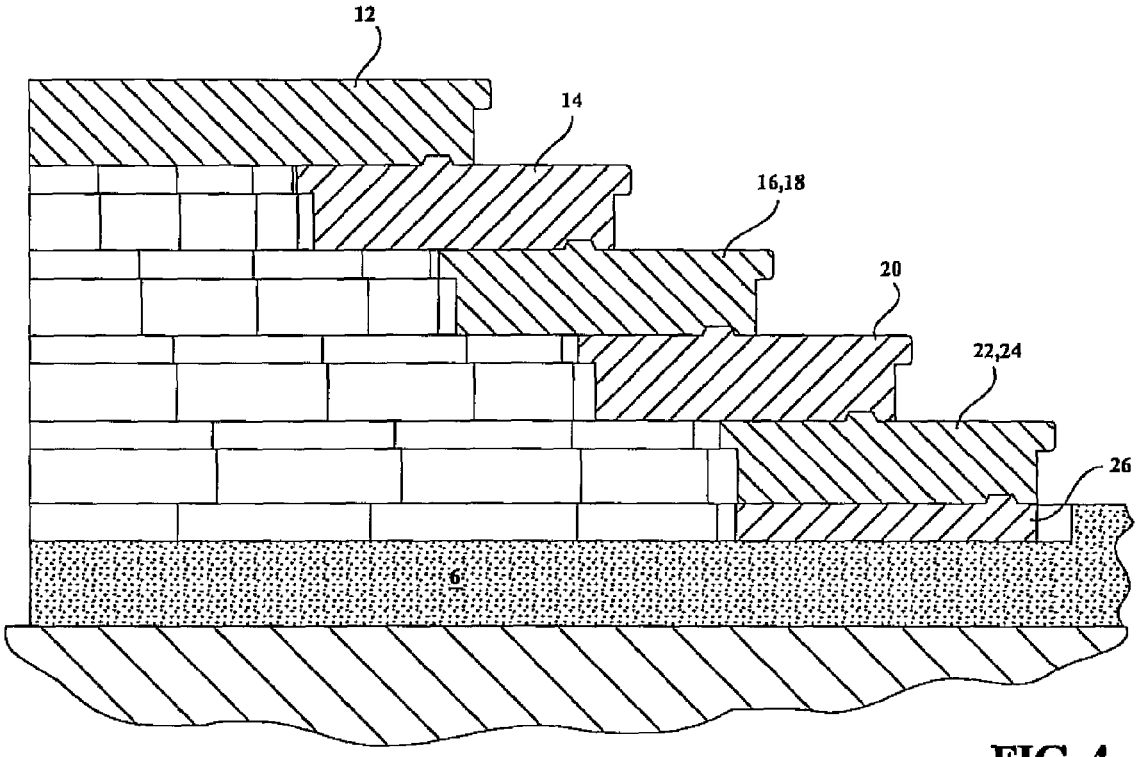
FIG. 4 is a side cutaway of FIG. 1 and which depicts a multi-tiered stacking arrangement of the assembly, this further exhibiting the tongue and groove configuration for establishing ease and rapidity of installation, along with such other features as a one piece bull nose configuration associated with each block.

A grading or support for the assembly 10 is depicted in each of FIGS. 2-4, at 6 and includes such as without limitation a compactible gravel which provides a bed upon which the bottom most array of blocks, e.g. again at 26 in FIG. 2, are initially embedded and supported. Alternatively, the bottom most layer of blocks can be supported upon a level cement pad (not shown). As will be further described, each of the succeeding/upper levels of blocks includes a recessed underside which can be filled with additional volumes of gravel as needed (see additionally side cutaway of FIG. 4) and in order to provide a secure base and interior for maintaining the structural integrity of the assembly. It is further envisioned that additional configurations of the present kit and assembly can include installing upon a solid concrete base or compactible material at grade level, with the remaining (upper tier) support blocks being stacked above grade in combination with or without filling their recessed interiors with additional volumes of compactible aggregate material. Along these lines, it is envisioned in one application that the various rectangular or square shaped (inner or hidden) components of the designated kit configurations can exhibit a hollow interior, with the half round shaped (outer or exposed) blocks being filled/weighted with the compactible aggregate.

As further shown in FIG. 4, and as will be explained in additional detail with reference to the succeeding views, and interlocking configuration of tongue and grooves are provided for assisting in providing interlocking supported between the vertically stacked layers. In combination, the succeeding assembled layers or levels are shown arranged in laterally offset and overlapping relationship, with further disclosed variants explaining that the mating tongue and groove profiles can additionally extend vertically between lateral edges of adjoining blocks.

Without limitation, FIG. 3 can depict either an initial layer of blocks alternate to that shown at 26 in FIG. 2 or, alternatively, can also depict a succeeding illustration of a second tier of blocks, such as previously depicted at 24, supported upon the first ground biased tier. FIG. 4 again shows a side cutaway of FIG. 1 and which depicts a multi-tiered stacking arrangement of the assembly, this further exhibiting the tongue and groove configuration (as will be described in further detail in succeeding illustrations) for establishing ease and rapidity of installation, along with such other features as a one piece bull nose configuration associated with each block, and as opposed to a two piece assembly such as is known with existing products.

Figure 5:
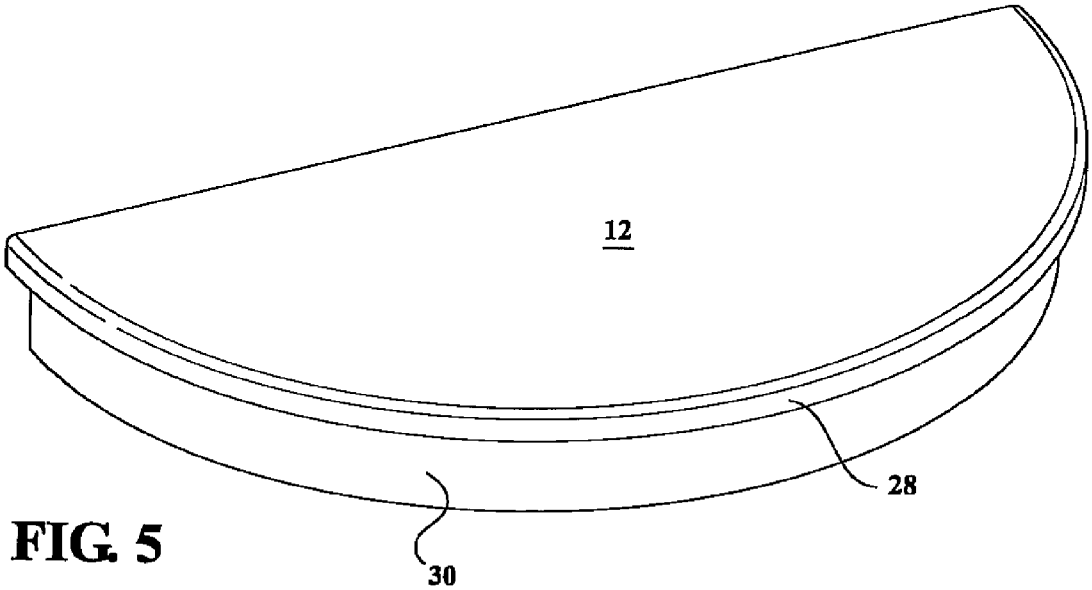
FIG. 5 is an upper perspective of a top most pad depicted in FIG. 1.

Proceeding to FIG. 5, an upper perspective view is shown of the top most pad 12 depicted in FIG. 1 and which includes a one piece body with semi-circular shape exhibiting a smooth top and a forward bull nose edge 28. A function of a rear bull nose configuration formed into the block also acts as a handle for facilitating ease of assembly. A front bull nose is provided for appearance and an optional second handle arranged opposite the handle defined by the rear bull nose. Additional block configurations are envisioned and which may not exhibit a rear handle (bullnose) configuration due to the design aspects desired, however the block construction may (alternately or additionally) include an opening to act as a handle.

Figure 6:
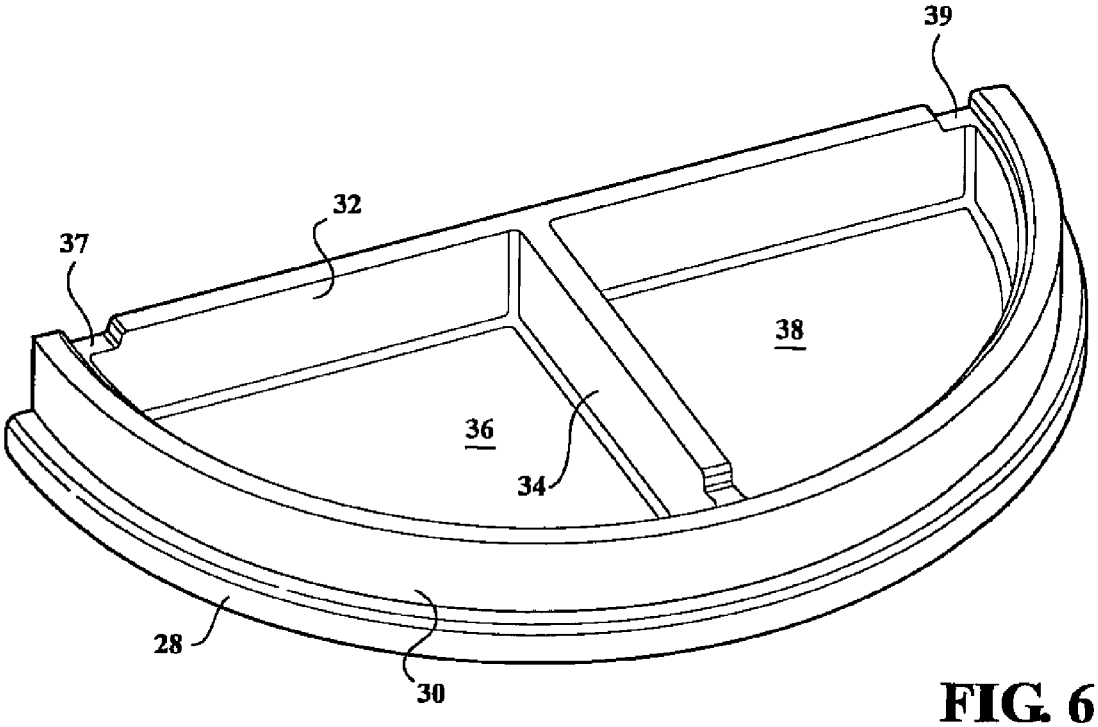
FIG. 6 is a rotated underside perspective view of the top layer pad of FIG. 5 and illustrating a recessed interior construction.

As further depicted in the rotated underside perspective view of FIG. 6, the top layer pad 12 illustrates a recessed interior construction established by a forward arcuate extending and outer wall 30 combined with a straight rear interconnecting wall 32 and a forward extending and middle interior and intersecting wall 34, these in combination defining pockets 36 and 38 which are fillable with gravel or the like during placement and settling and without the need for mortar or other special tools or saws. The underside view of FIG. 6 also best shows notched locations 37 and 39 where opposite outer edges of the rear interconnecting wall 32 meet the rearmost locations of the outer arcuate wall 30.

Figure 7:
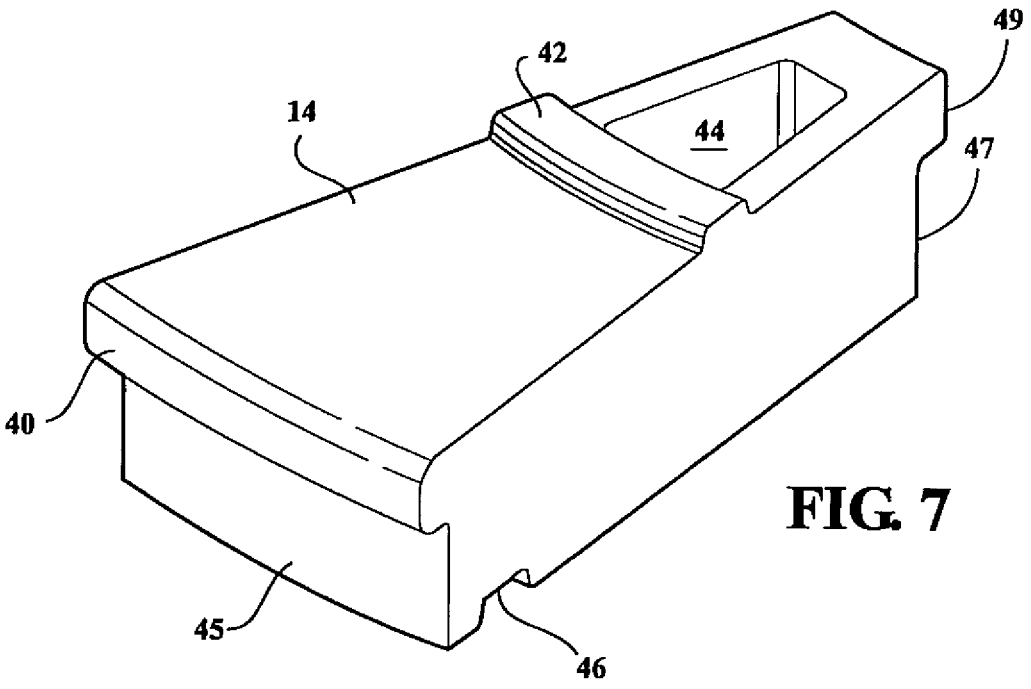
FIG. 7 is an upper perspective view of an inter-assembleable block construction associated with a second upper most layer of the assembly depicted in FIG. 1.
Figure 8:
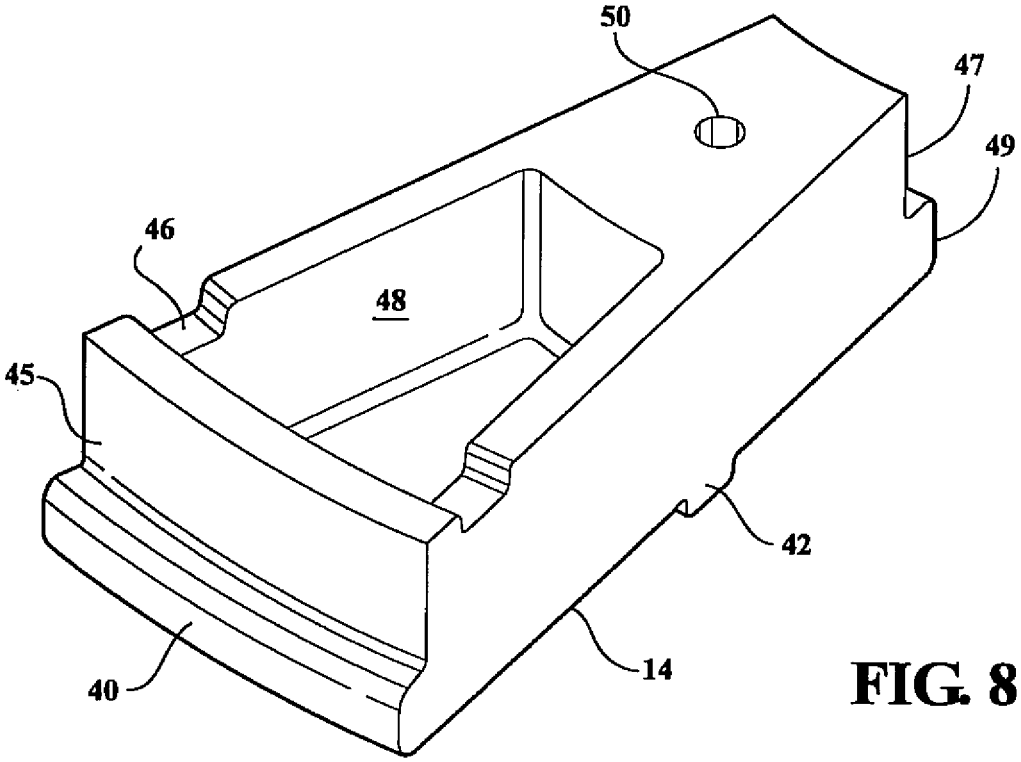
FIG. 8 is a rotated underside perspective view of the second layer block depicted in FIG. 7.

FIG. 7 is an upper perspective view of an inter-assembleable block construction associated with one of the selected second upper most layer blocks 14 of the assembly depicted in FIG. 1, with FIG. 8 further depicting a rotated underside perspective view of the second layer block depicted in FIG. 7. As shown, the block exhibits a one piece construction with a forward bull nose edge 40 at an arcuate upper tongue or protuberance 42 at an inner-intermediate location separating a smooth exposed surface of the step and an inner recess configured location 44. The protuberance 42 is configured for receiving the outer arcuate wall 30 of the upper pad 12 in an inner seated and supported fashion, with the protuberances 42 of opposite edge most located blocks seating within the notched locations 37 and 39 of the upper pad 12.

The bull nose 40 extends from a front wall 45, with an underside groove 46 is depicted in each block 14 proximate its outer perimeter located on an inside edge of the front wall, and which is configured for seating upon a tongue of an underside located layer of blocks, as again clearly depicted in cutaway in FIG. 4. A recessed volume 48 is defined in the outer portion of the block 14 as shown in FIG. 8 and which alternates with the upper accessible volume 44 shown in FIG. 7. A rearward wall 47 of the block 14 exhibits an upper stepped ledge 49, such that the arcuate assembly of each layer of blocks facilitates a back fill of grave, pea stone or other compactible material in a fashion which provides additional ballasting support along the horizontal and vertical interior volume defined between the upper most pad 12 underside and the lower most grade level section or tray 26. Reference is also made to the side cutaway of FIG. 4 which depicts in line depiction outer located blocks associated with each ascending level or tier with the understanding that additional volumes of gravel or pea stone or deposited into the ascending and restricting interior defined by the successively stacked layers in order to create a structurally supporting and secure assembly.

An aperture 50 is shown in FIG. 8 and which communicates with any of the upper recessed area 44 or which can access a hidden electrical pad which can be inserted into each of the blocks (as will be further described in succeeding embodiments). It is also envisioned that any arrangement or network of apertures can be formed within the assembled levels of blocks, such as for accommodating a junction box with designated electrical wires, or alternatively any other convective fluid network for providing heat to a surface area associated with the blocks in order to facilitate ice and/or snow melt-off.

The arrangement and configuration of an interconnecting aperture network can further be such that it facilitates any needed drainage or runoff of moisture building up within the interior of the block assembly, into the underlying gravel or other external or grade tile location, this in order to maintain the structural integrity of the assembly. As further depicted in FIG. 1, the blocks are arranged in side-by-side plural aligning fashion (the indicated variant depicting eight such blocks establishing a semi-circular shape).

Figure 9:
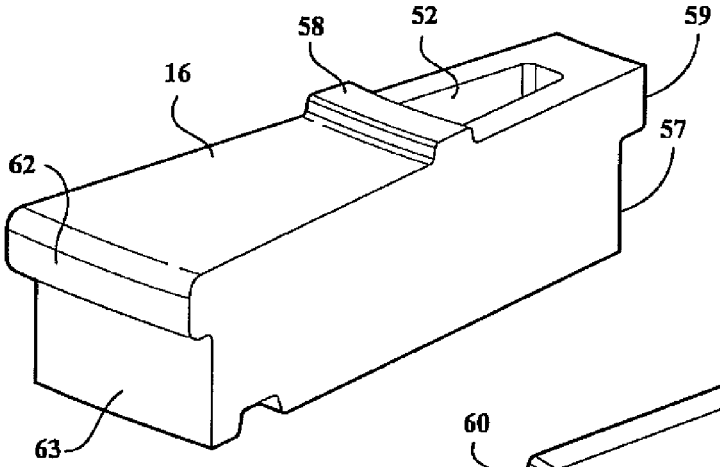
FIG. 9 is an upper perspective view of a selected one of a pair of end-most disposed blocks associated with a third row of inter-assembleable blocks.
Figure 10:
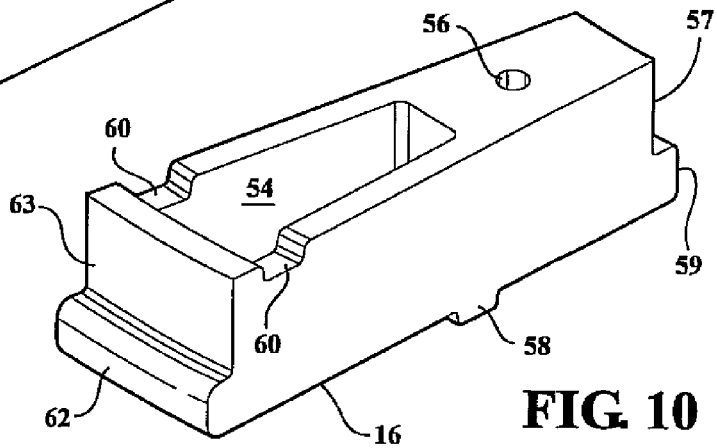
FIG. 10 is a rotated underside perspective view of the end disposed blocks of FIG. 9 and depicting each of an alternating recess profile as well as a channel communicating with an upper side recess located rearwardly of an upper tongue profile.

FIG. 9 is an upper perspective view of a selected one of the pair of end-most disposed blocks 16 associated with a third row of inter-assembleable blocks. As further shown in the rotated underside perspective view of FIG. 10, each of the pair of end positioned blocks 16 depict upper 52 and lower 54 recess profiles, as well as a vertical aperture 56, upper (arcuate width extending) tongue 58, and lower (arcuate width extending) groove locations 60. A rear arcuate edge 57 of the block 16 exhibits an upper edge extending ledge 59 which, similar to the ledge previously depicted at 49 in FIG. 7 for block 14, provides additional inner locating edge support in combination with the in-filled volumes of gravel, pea stone or other weighted and compactible material. The block further exhibits forward bull nose 62 is also shown extending from a front arcuate wall 63.

Figure 11:
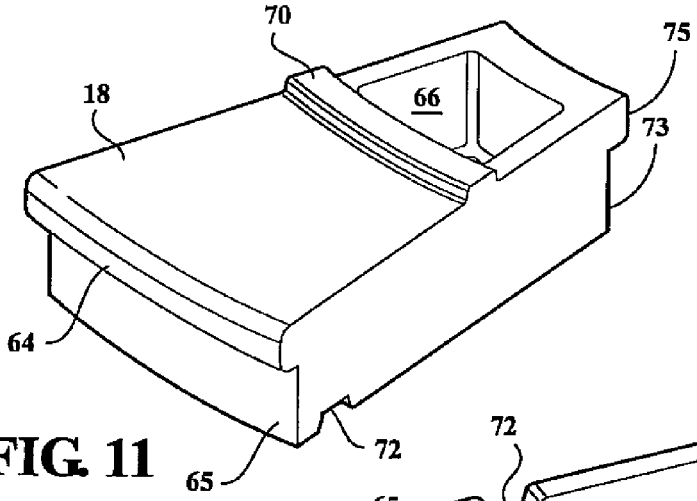
FIG. 11 is an upper perspective of a further block configuration associated with the third row and of which a plurality are inter-assembled between said pair of end-most disposed blocks of FIG. 9.
Figure 12:
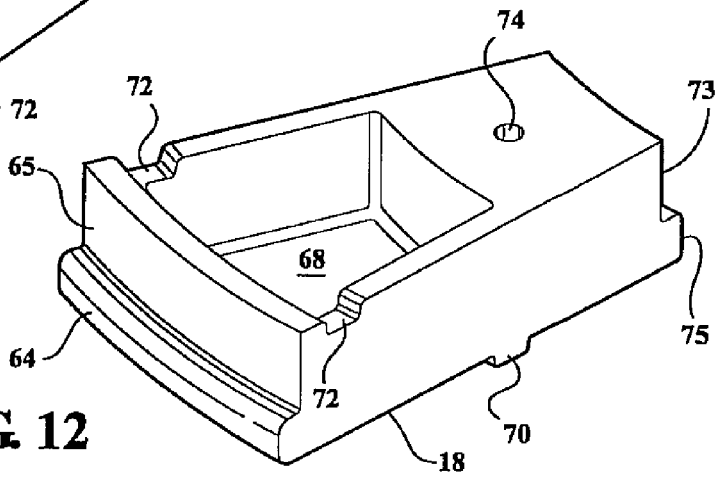
FIG. 12 is an underside rotated perspective view of the block in FIG. 11 and exhibiting a similar alternating recess profile construction as referenced in the end-most disposed blocks of FIG. 9.

FIGS. 11 and 12 depict both upper and rotated underside perspectives of the further block configuration 18 associated with the third row, and of which a plurality (such as eight shown) are inter-assembled between said pair of end-most disposed blocks of FIG. 9. As with the previous block constructions, the block includes a forward bull nose edge 64 extending from an upper perimeter location of a front wall 65 as well as alternating upper 66 and lower 68 recessed configurations are defined in rearward and forward accessible locations of the blocks 18, these in combination with upper tongue 70 and lower groove 72 depictions. Also shown is aperture 74 in similar fashion as in preceding variants. Also shown is a rear wall 73 with an upper edge projecting ledge 75.

Figure 13:
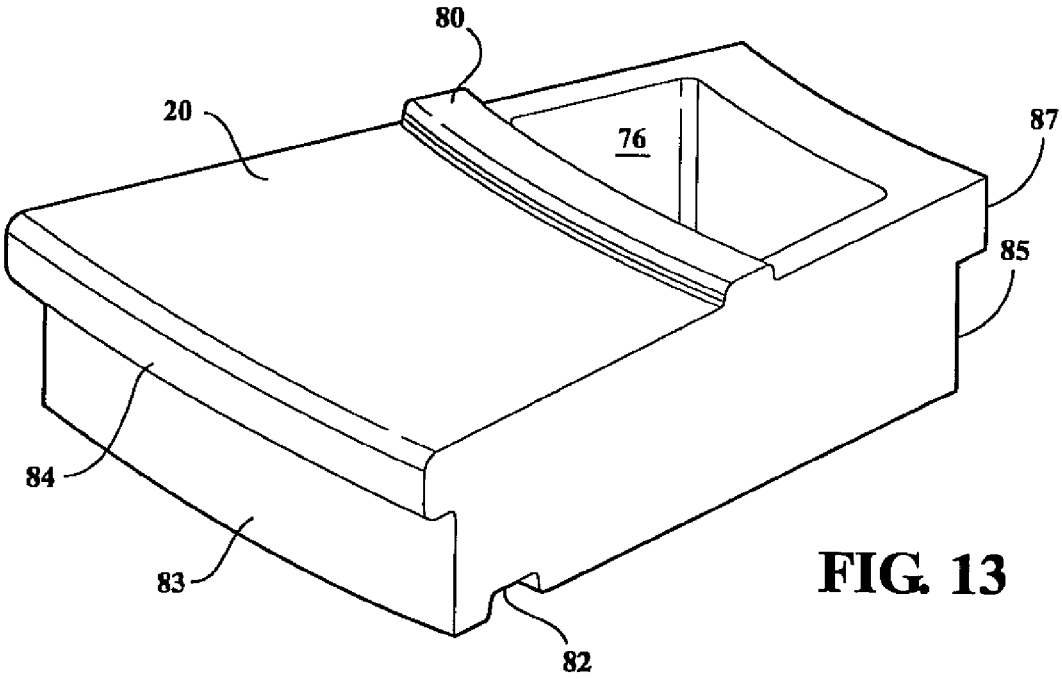
FIG. 13 is an upper perspective view of a fourth level block configuration which is progressively larger in overall dimension than preceding layer defining blocks and which exhibits a similar configuration as shown in the preceding blocks depicted in each of FIGS. 7, 9 and 11.
Figure 14:
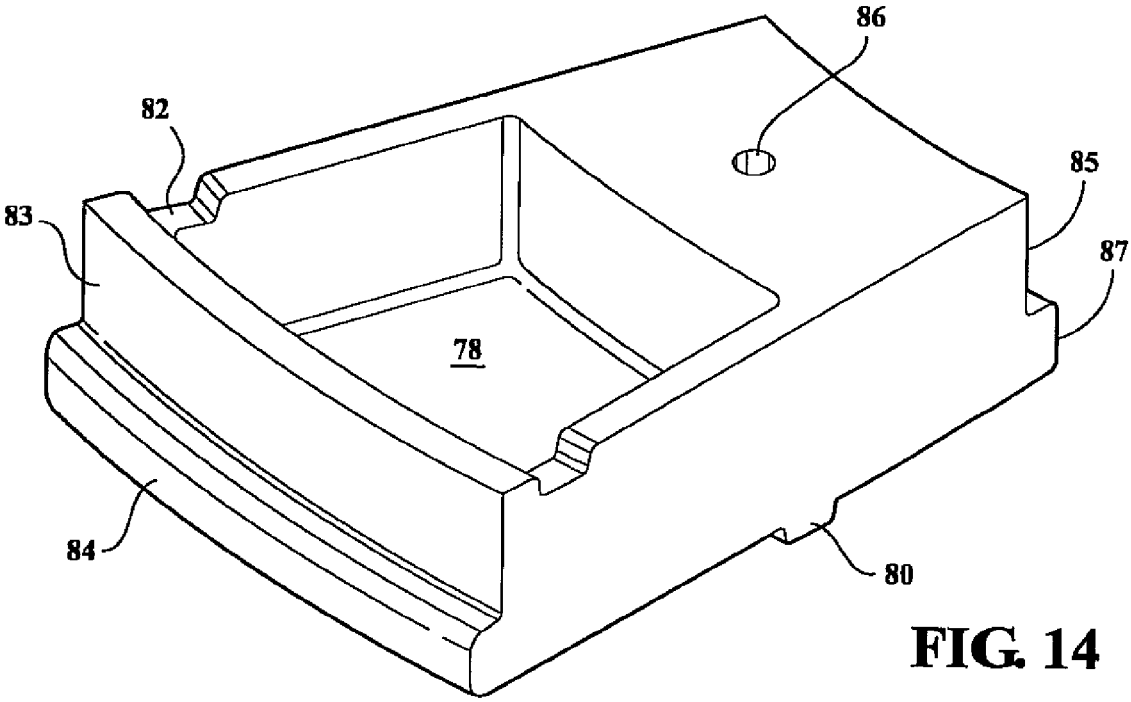
FIG. 14 is a rotated underside perspective view of the block shown in FIG. 13 and exhibiting a similar alternating recess profile construction.

FIGS. 13 depict upper and rotated underside perspectives of a fourth level block 20 configuration which is progressively larger in overall dimension than preceding layer defining blocks 14 and 18 shown in each of FIGS. 7, 9 and 11. A plurality of such blocks (nine shown) include alternating upper 76 and lower 78 recess profiles, along with upper tongue 80 and lower grooves 82. A forward edge 83 is provided and from which a forward bull nose edge is shown at 84 in upper perimeter extending fashion along with an underside accessible aperture 86. A rear wall 85 includes an upper perimeter projecting ledge 87 of similar construction and application as with the preceding described blocks.

Figure 15:
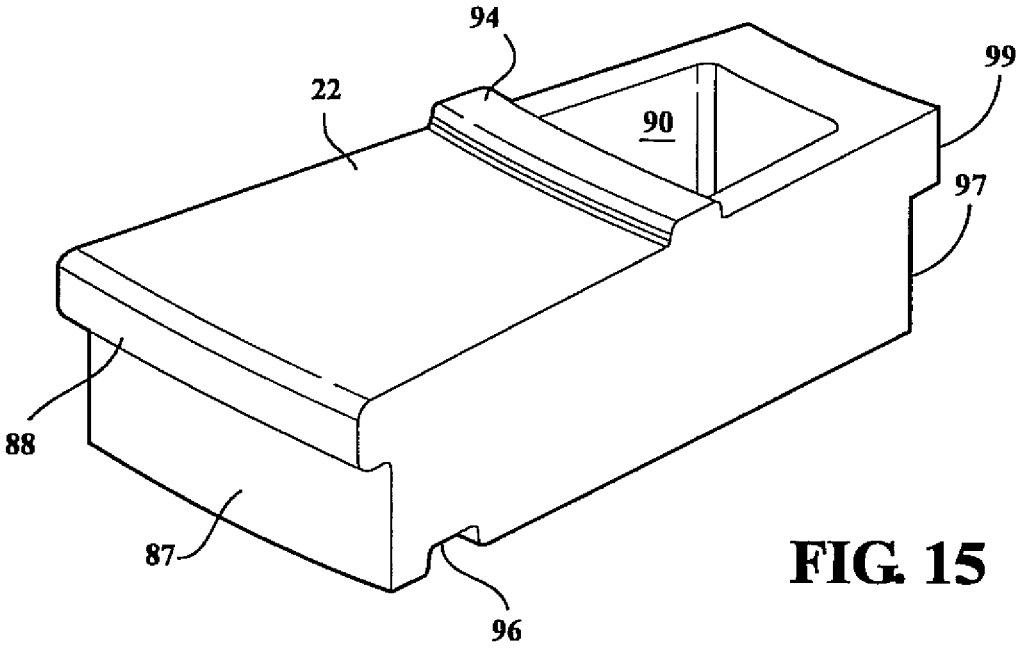
FIG. 15 is an upper perspective view of a selected one of a pair of end-most disposed blocks associated with a fifth row of inter-assembleable blocks.
Figure 16:
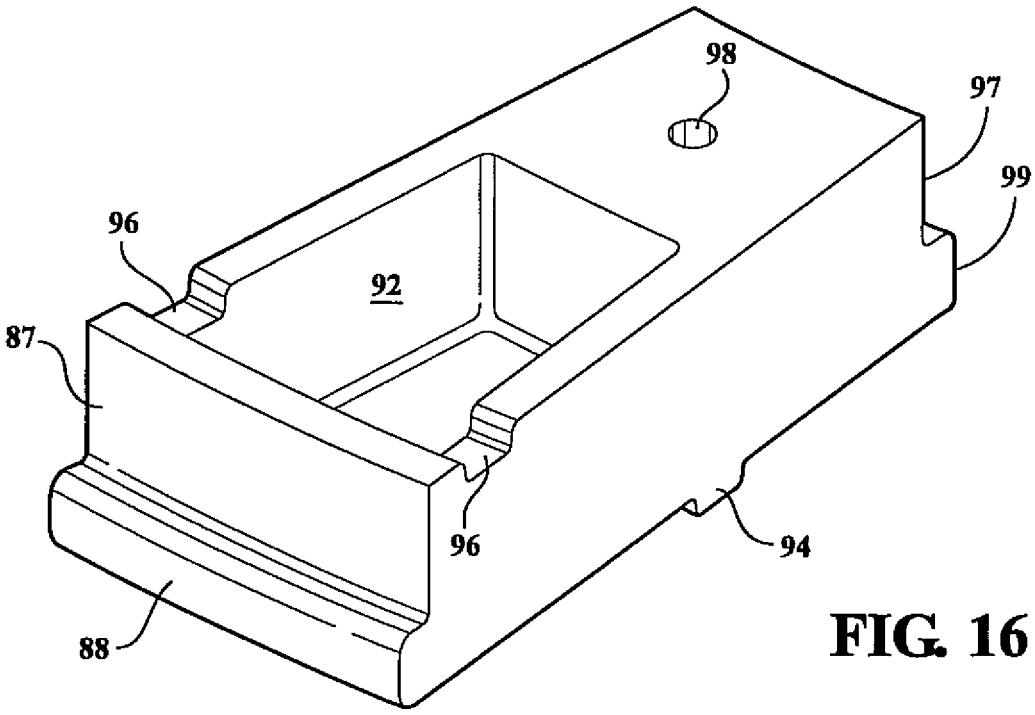
FIG. 16 is a rotated underside perspective view of the block depicted in FIG. 15.

FIGS. 15 and 16 are upper and lower rotated perspective views of a selected one of a pair of end-most disposed blocks 22 associated with a fifth row of inter-assembleable blocks. As with the previous block constructions, the block 22 includes a forward wall 87 from which projects a bull nose edge 88, as well as alternating upper 90 and lower 92 recessed configurations are defined in rearward and forward accessible locations of the blocks 22, these in combination with upper tongue 94 and lower groove 96 depictions. Also shown is aperture 98 in similar fashion as in preceding variants. A rear arcuate wall 97 is provided with an upper perimeter ledge 99.

Figure 17:
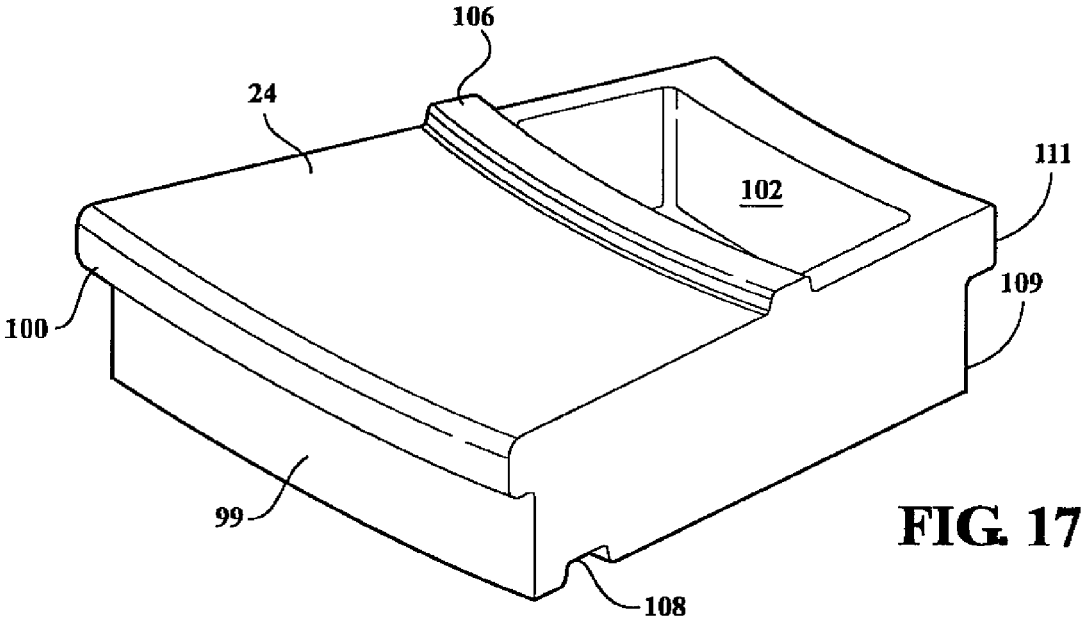
FIG. 17 is an upper perspective of a yet further block configuration associated with a fifth row of which a plurality are inter-assembled between said pair of end-most disposed blocks of FIG. 16.
Figure 18:
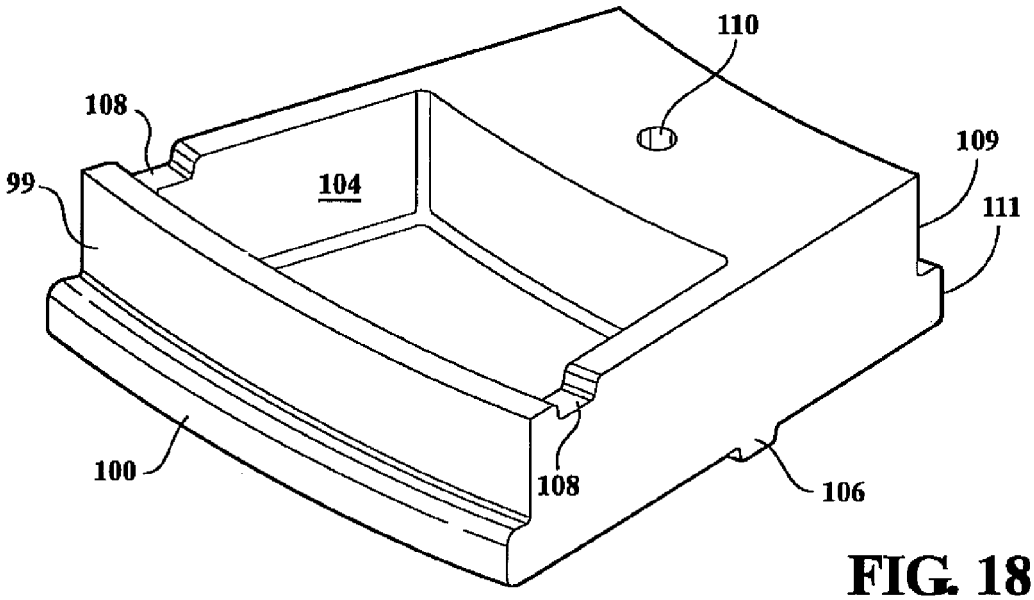
FIG. 18 is a rotated underside perspective view of the block depicted in FIG. 17.

FIGS. 17 and 18 are upper and lower rotated perspective views of an intermediate aligning plurality 24 of additional fifth row blocks which are inter-assembled between the pair of end-most disposed blocks 22 of FIGS. 15 and 16. A plurality of the blocks 24 (such as eight which are shown) are inter-assembled between the pair of end-most disposed blocks 22. As with the previous block constructions, the block 24 includes a forward arcuate wall 99 with a projecting bull nose edge 100, as well as alternating upper 102 and lower 104 recessed configurations are defined in rearward and forward accessible locations of the blocks 24, these in combination with upper tongue 106 and lower groove 108 depictions (these again arranged in outer side locations of the block underside located against and inside surface of the forward wall 99). Also shown is aperture 110 in similar fashion as in preceding variants. A rear wall 109 also exhibits and upper perimeter projecting ledge 111.

Figure 19:
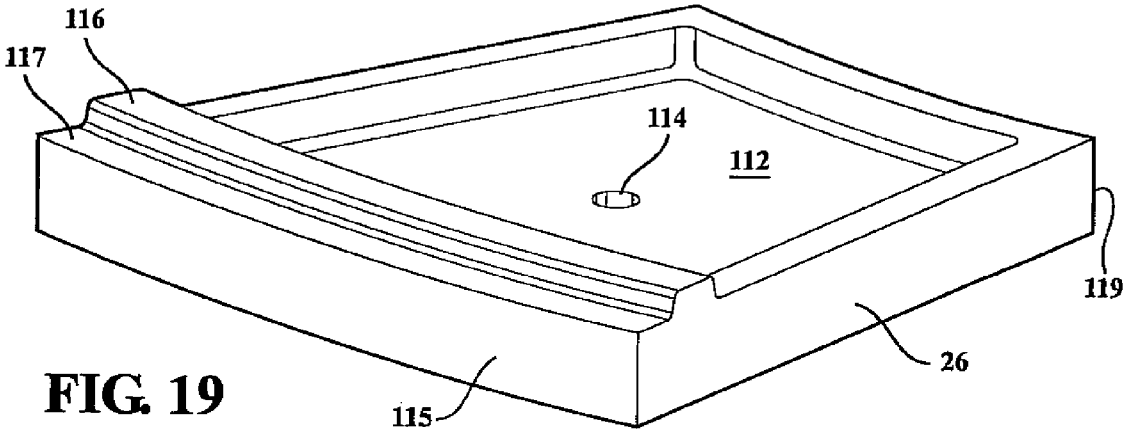
FIG. 19 is an upper perspective of a base level located construction block, such as which is installed on a gravel bed below grade.
Figure 20:
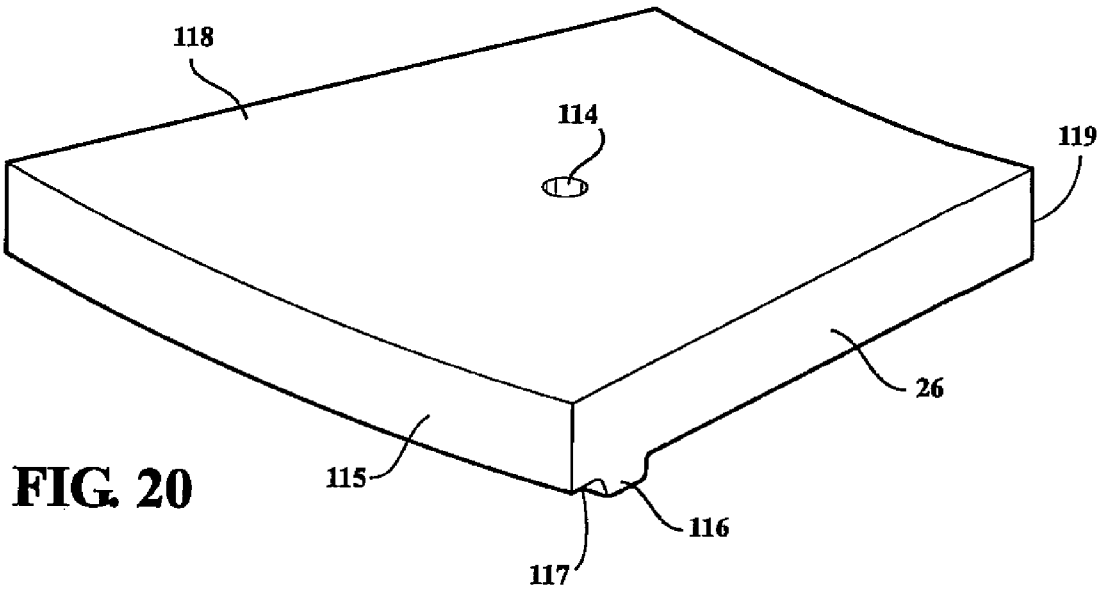
FIG. 20 is a rotated underside perspective view of the construction block of FIG. 19 and which exhibits a flattened surface through extends a channel in communication with the channels formed through the upper succeeding levels.

FIG. 19 is an upper perspective of the base level block 26 which is installed on a gravel bed below grade and includes a recessed interior 112 with a central positioned drainage hole 114. Repetitive features again include an upper/outer edge exhibited and arcuate/width extending groove 116. FIG. 20 is a rotated underside perspective view of the base level block 26 and which exhibits a flattened bottom surface 118. Also shown is a front end wall 115, a lip edge location 117 separating the front wall 115 from the projecting groove 116, and a rear wall 119.

Figure 21:
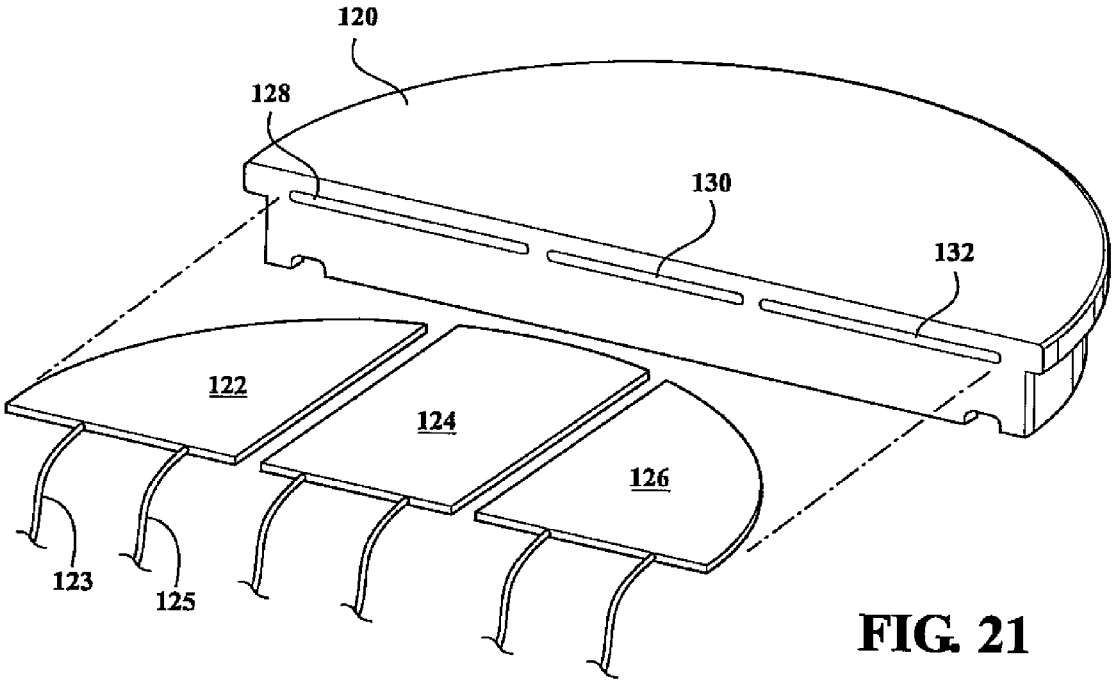
FIG. 21 is an exploded perspective of a top level pad, such as previously depicted in FIG. 5, and which illustrates a plurality of heating pads installable within upper surface proximate locations to facilitate melt-off of snow or ice accumulations.

Proceeding to FIG. 21, an exploded perspective is shown of a top level pad 120 according to a further variant, similar to that previously depicted in FIG. 5, and which illustrates a plurality of heating pads 122, 124 and 126 (these exhibiting thin wafer-like profiles) which are installable within upper surface proximate locations, such as pockets 128, 130 and 132 accessible from a rear flat edge surface of the pad 120, this in order to facilitate melt-off of snow or ice accumulations. As will be further described in additional detail in succeeding views, the pads or like thin wafer inserts 122, 124 and 126 can exhibit any type of electrical resistance generating elements which are embedded within surface proximate locations of the pad 120, this in order to communicate (such as via heat conduction) the heat emanations generated by the inserts in order to warm and thermally melt any ice or snow accumulations upon the top surface of the pad 120.

Each of the pads 122, 124, 126 can exhibit a pair of electrical leads or wires, these including input 123 and output 125 for selected pad 122, the leads or wires providing power in communication with any suitable electrical resistor element or the like contained within the body of the pad which generates a desired amount of thermal energy (i.e. heat) which is communicated via conduction to the exterior of the block to facilitate melt off of snow and ice). The pair of wires or leads associated with each of the pads can be daisy chained or otherwise connected together in order to communicate a single power source to all of the heat generating pads, such connection further including wiring the pads in series of parallel for individual tiers or levels. As will be described in further detail with reference to the succeeding embodiments of FIGS. 36 et seq., the assembly can be constructed such that the heating pads are replaceable without destroying or otherwise adversely affecting the precast block construction.

Figure 22:
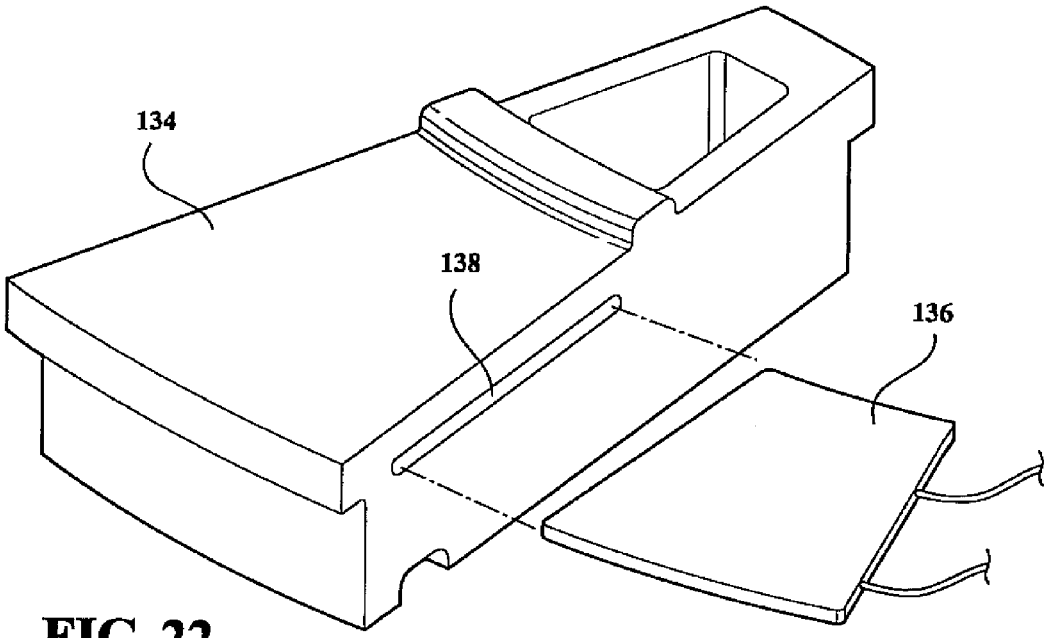
FIG. 22 is an upper perspective view of a second level block, similar to that shown in FIG. 7, and illustrating a sideways installed heating pad extending within a pocket underlying an exposed step area of the block.

FIG. 22 is an upper perspective view of a variation 134 of a second level block, similar to that shown in FIG. 7, and illustrating a sideways installed heating pad or insert 136 extending within a like configured and sideways accessible pocket 138 underlying an exposed step area of the block. Reference is also made to the rotated underside perspective view of FIG. 23 of the block shown in FIG. 22 and additionally illustrating an alternate recess configuration with horizontal define and underside channel 140 leading to an underside in-fill receiving cavity 141. Without limitation, each block configuration can include a suitably recessed thin pocket (again at 138) for receiving a closely tolerance pad, such as which can be easily added following installation (such as including disassembling each block and installing the heating filament or pad with the use of an industrial sealant).

Figure 24:
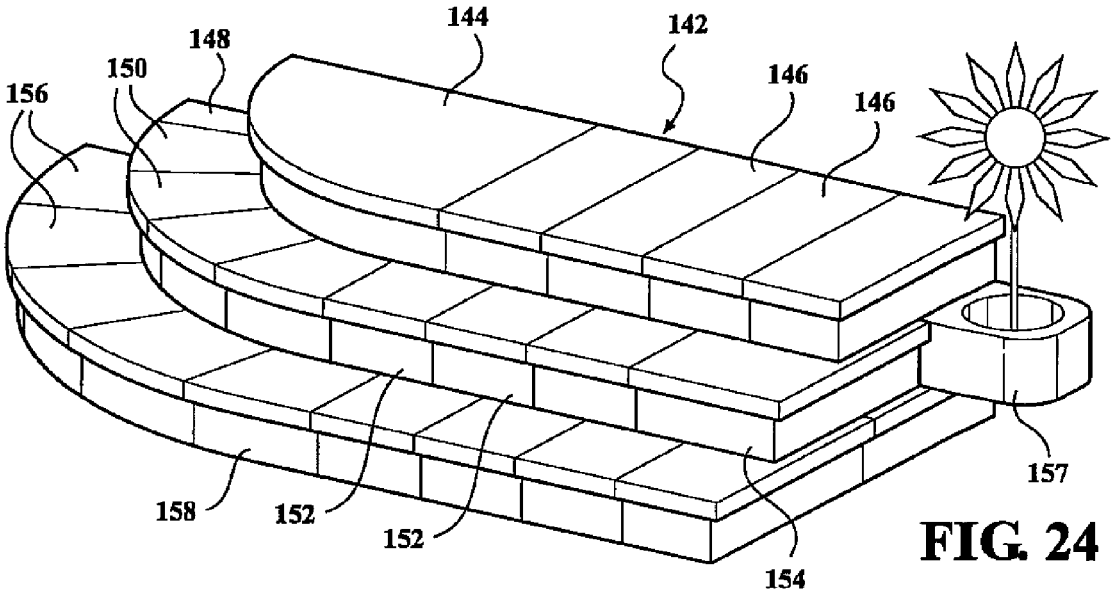
FIG. 24 is a perspective view of an alternately configurable and assembleable block assembly depicting an elongated three dimensional shape as compared to FIG. 1.

FIG. 24 is a perspective view, generally at 142, of an alternately configurable and assembleable block assembly consistent with the preceding description and depicting an elongated three dimensional shape as compared to FIG. 1 and which includes a modified top pad 144, aside which are aligned a plurality (such as four shown) of additional elongated top surface rectangular blocks 146. Additional second tier blocks include end-most position block 148, additional arcuate blocks 150, and elongated and straightened blocks 152 and 154. A third or bottom most level of aligning blocks are further shown by arcuate plurality of blocks 156 and further straight elongating blocks 158. Also shown is a shelf attachment 157 which can be secured or otherwise supported to a side ledge location of a given layer or tier, or adjoining layers, such as with any type of tongue and groove or other interconnecting structure and thereby providing by non-limiting example a flower pot or other accessory for integrating into the overall assembly.

Figure 25:
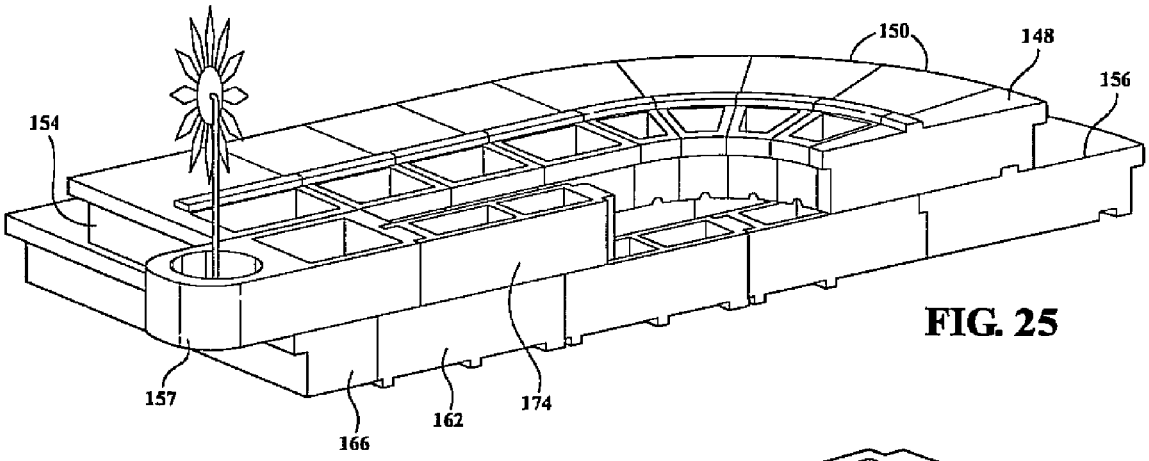
FIG. 25 is a rotated rear view of FIG. 24, in partial upper horizontal cutaway, and better showing the interlocking tongue and groove profiles for facilitating stack-ability of the blocks.
Figure 26:
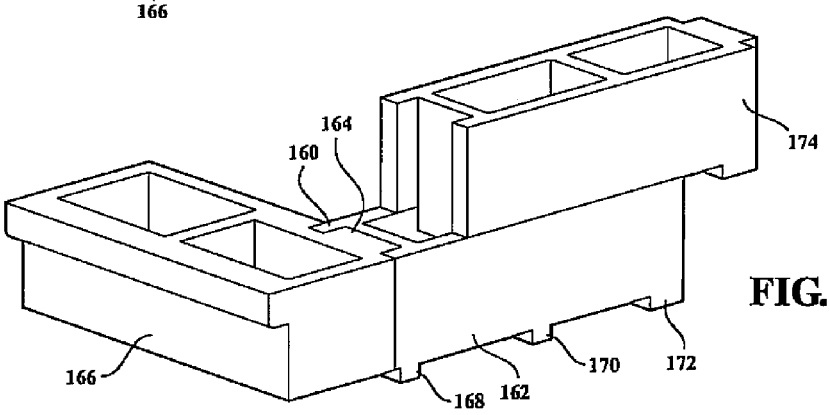
FIG. 26 is a partial perspective of FIG. 25 depicting additional vertical extending tongue and groove profiles for further facilitating inter-locking of the stackable layers in both horizontal and vertical directions.

FIG. 25 is a rotated rear view of FIG. 24, in partial upper horizontal cutaway, and better showing the interlocking tongue and groove profiles of additional support blocks 162, 166 and 174 which facilitating stack-ability of the second 150 and third 156 tier blocks. These are further shown in the partial perspective of FIG. 26 and which depicts additional vertical extending tongue and groove profiles, such as shown by tongue 160 shown by inner tier block 162, this interlocking with aligning and vertical extending grooves 164 established within further located block 166. As further shown, horizontal extending tongues (see at 168, 170 and 172) can be defined along either of top or bottom projecting edges of each stackable layer (see additional level or tier defining block 174) such that the interlocking of the blocks extends in each of horizontal and vertical directions in order to interlock with rearward locations of the outer arrayed and stacked blocks and to provide structural support along the interior volume established by the tiered blocks 156, 150 and 142-146 depicted in FIG. 24.

The blocks 162 and 174 can be similar in shape and construction and which are referred to as support blocks for the upper most blocks to sit upon. The blocks are further reconfigurable within any of a number of differing configurations, such as which can be associated with a standard kit. The blocks may further jointly form a pocket or hollow compartment for containing volumes of the compactible gravel, such as when no suitable back support wall is available to contain the gravel in the application of each kit.

Figure 27:
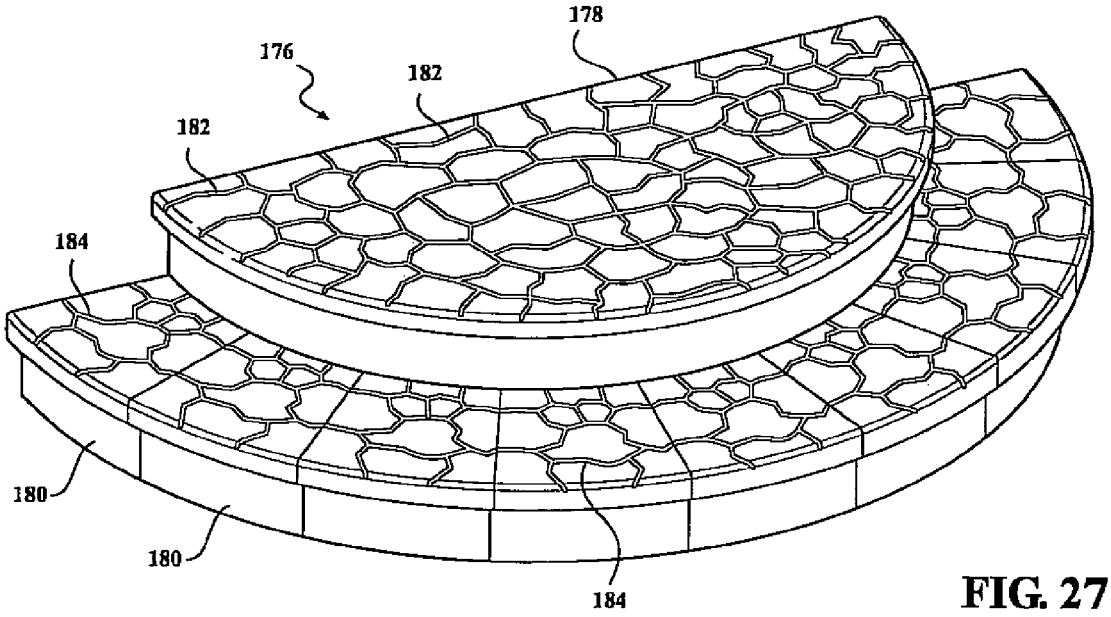
FIG. 27 is a perspective illustration of a top pad and assembled second layer exhibiting pre-cast decorative patterns exhibited along at least exposed horizontal surfaces and according to a further embodiment.

Referring now to FIG. 27, a perspective illustration is generally shown at 176 of a top pad 178 and assembled second layer defusing blocks 180 (see also each of succeeding FIGS. 28-30), each exhibiting pre-cast decorative patterns exhibited along at least exposed horizontal surfaces and according to a further embodiment. The decorative patterns shown represent but one possible arrangement or pattern and can include any type of recessed or embossed pattern which can extend across the horizontal and/or vertical riser surfaces of the top pad and underneath positioned and assembled blocks such that, and upon assembly, a separate stamping or imprinting of a curing cement material is unnecessary. As further shown, the decorative patterns (see outlines 182 in top pad 178 and additional outlines 184 in selected underneath assembled block 180 in FIG. 27) can exhibit any style or arrangement and, by benefit of being a part of the initial manufacture of the pad and individual blocks, provides significant ease of use and reduction in install time.

Figure 28:
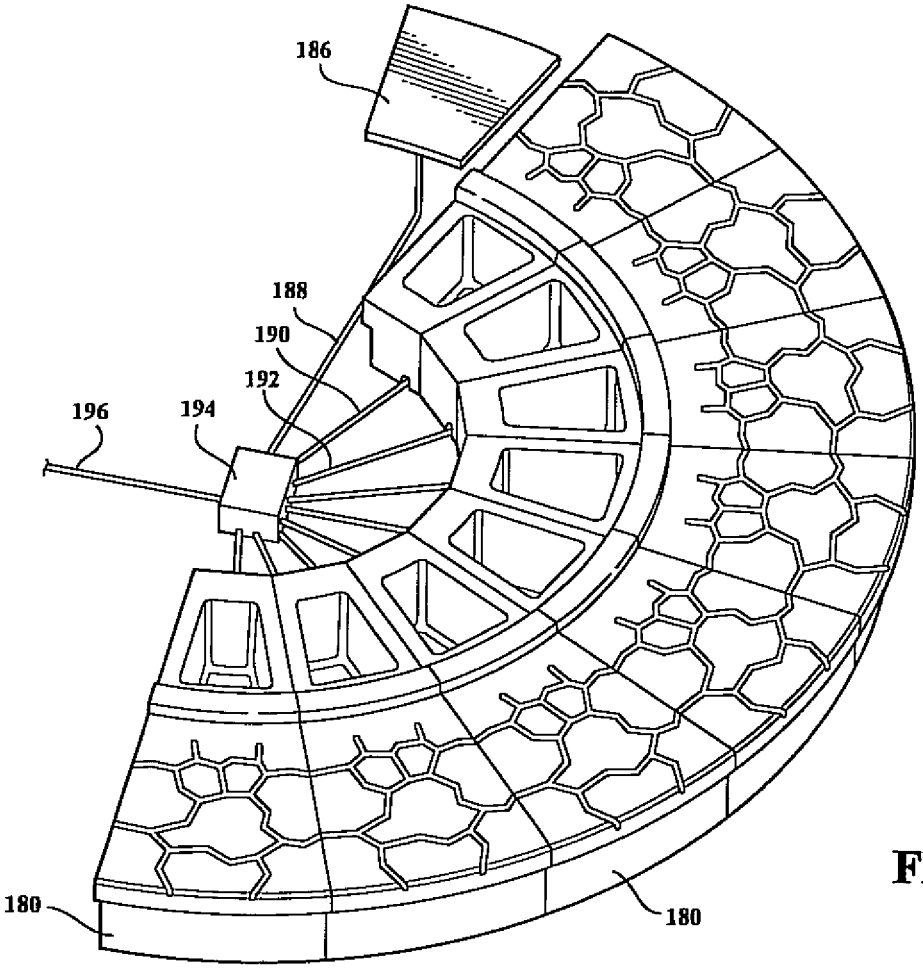
FIG. 28 is a succeeding illustration of FIG. 27, depicting the top pad removed and further showing a connecting network of heating pads and wiring associated with the second assembled layer and including a junction box and main power cord.
Figure 29:
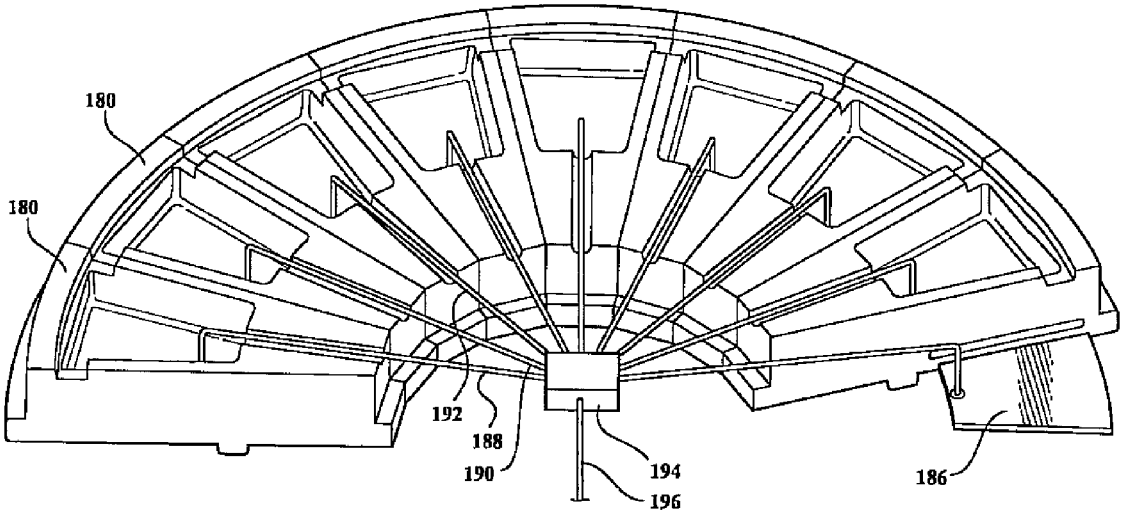
FIG. 29 is a rotated underside perspective view of FIG. 28.
Figure 30:
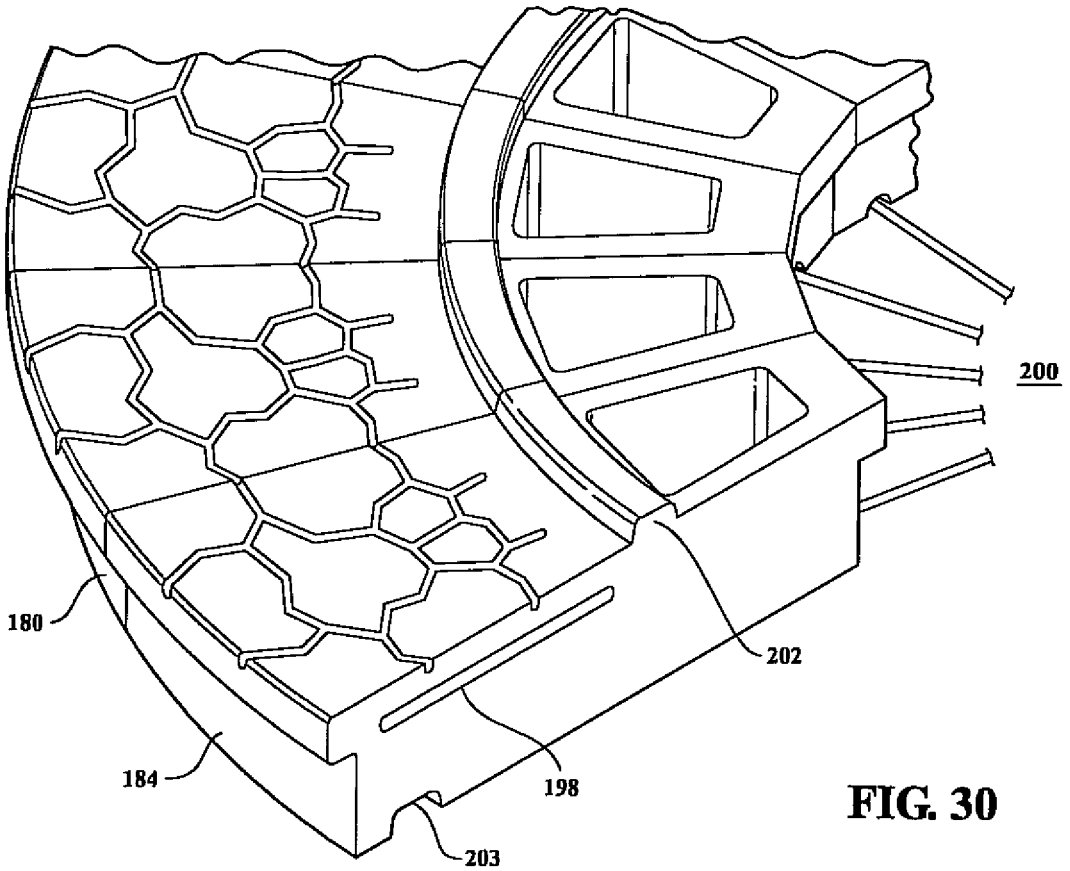
FIG. 30 is an enlarged perspective of FIG. 28 and further depicting the features of the exposed stamped patterns formed in the precast blocks, along with smooth and flat boundary locations separating the pre-cast decorative patterns and the interlocking tongues and for assisting in maintaining a level surface for stacking the upper succeeding (top pad) layer.

FIGS. 28 and 29 are succeeding illustrations to FIG. 27 and depict both upper and lower rotated views of the top pad removed, this in order to further show one non-limiting example of a connecting network of heating pads or inserts (see as shown by example at 186) and wiring (see further plural wiring 188, 190, 192, et. seq.) associated with the second assembled layer and including a junction box 194 to which extends a main power cord 196 from a remote power supply, with the individual wiring 188, 190, 192 extending therefrom to the individual installed pads 186. The pads 186 or filaments install within recessed pockets defined in sideways receiving locations of each block (see further at 198 in enlarged view of FIG. 30). Although not clearly shown, any desired network or configuration of wiring can be employed in providing resistive heating to the various pads, such further including additional wiring to ground.

As further previously described, substitute heating mediums can be employed and which are not limited to geothermal (i.e. the feeding of a water based fluid medium via a pump or other circulating system within a closed loop and in order to transfer heat from an underground location for thermal conduction through the blocks or assembled tiles to their upper surfaces to facilitate snow or ice melt off). Alternate to geothermal heat transfer, a solar collector shield can be used in conjunction with a readily reconfigurable pipe or conduit network in an easily adaptable variant. The enlarged perspective of FIG. 30 further depicts the features of the exposed stamped patterns 184 formed in the precast blocks, along with smooth and flat boundary locations 200 separating the precast decorative patterns and interlocking tongues 202 and underside grooves 203 and for assisting in maintaining a level surface for stacking the upper succeeding (top pad) layer 178.

Figure 31:
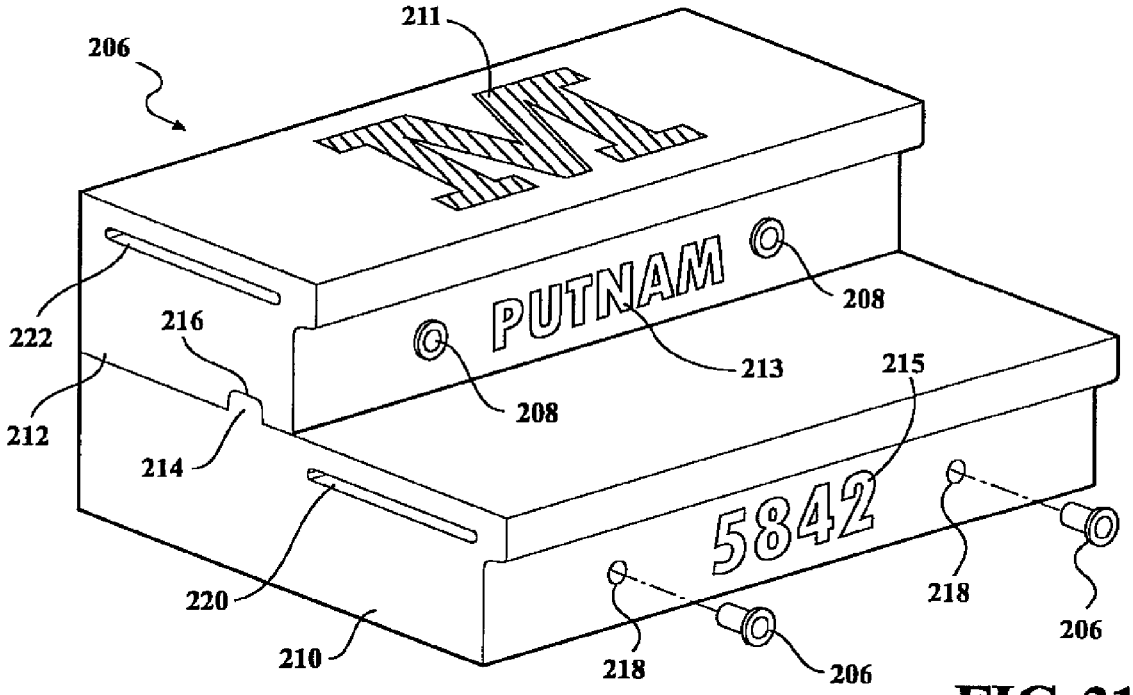
FIG. 31 is a perspective view of a further variant of assembly exhibiting vertical (riser) surface located effect lighting along with indicia molding schemes which are built into the block designs.

Referring now to FIG. 31, a perspective view is shown at 204 of a further variant of assembly exhibiting vertical (riser) surface located effect lighting (see pairs of LED or like illuminating elements 206 and 208) which are mounted within vertical riser locations of a pair of pre-fabricated and stacked blocks or steps shown at 210 and 212, respectively. Without limitation, the LED lighting elements can include such as those sold under the commercial name "Aurora Phoenix Recessed LED Light Kits" and which may be applied to vertical riser locations of any one or more selected step blocks. Other light kits can further be installed into the horizontal surfaces of the blocks, these including without limitation "DEKOR LED Dek Dot Kits". As also shown, the steps 210 and 212 can exhibit a similar tongue 214 and groove 216 inter-seating profile.

The LED elements 206 and 208 are further depicted as installed within seating recesses, see further at 218 which is defined in a reverse interior wall location of a selected forward riser for lower positioned step or block 210. Heating or other electrical resistant pads are further shown at 220 in relation to a sideways inserting edge of the lower block 210, and which are individually inserted into pockets (see further as best shown at 222 for upper stacked block 212).

Figure 32:
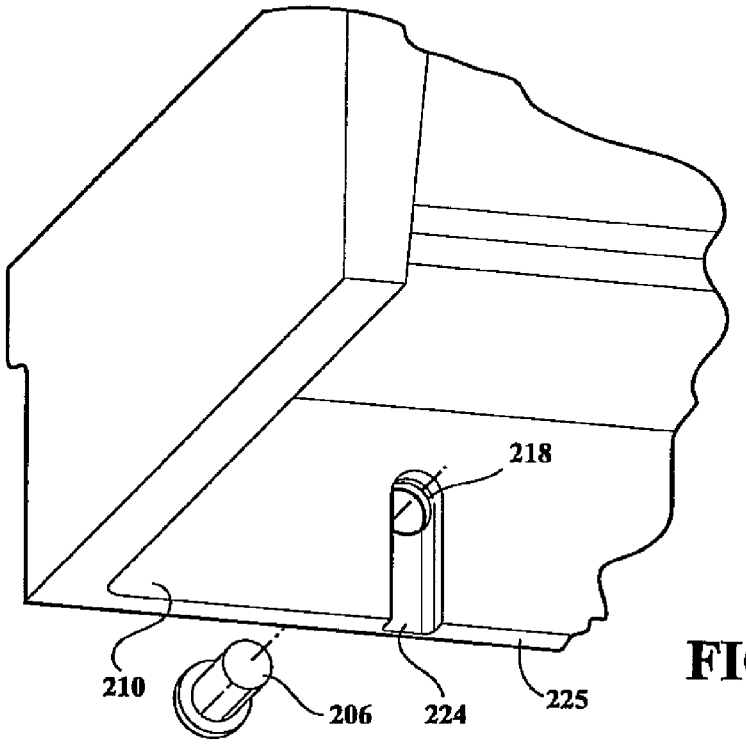
FIG. 32 is a rotated underside perspective view of FIG. 31 illustrating a recess pocket defined through a rear side vertical surface of the block, such as for receiving an LED light.

The lighting elements can include any type of low voltage light and which can include a portable/solar power generated capacity as well as optionally being electrically communicated by wiring in a similar nature as depicted by the heat resistant generating pads. As further shown in the rotated underside perspective view of FIG. 32, the recess apertures 218 enable installation of the lights at any time and which are installed from an interior/rear side location, such as further assisted by a reverse side slot 224 accessible through an underside edge 225 of the step block 210. On this point, the slot 224 is not needed in the instance of a horizontally mounted LED element and as is further shown in reference to FIGS. 35B-35E.

In this manner, the light recesses can be drilled out at any time, including prior to or subsequent initial assembly, in the latter instance following partial disassembly of a pre-assembled construction and in order to permit the fabricator to drill out the desired apertures from the back side prior to installation of the lighting elements. Additionally, it is noted that the light emitting diode (LED) elements 206 and 208 can be substituted by other suitable illuminating elements not limited by the present description, and such as which can adequately function in external environments and which, along with the LED style elements, can be electrically connected or otherwise wired in order to provide seasonal or daily lighting patterns, such including communicating a timer or light sensor for activating the LED's or other lighting patterns at given times (such as evening darkness hours).

Additional features include the ability to incorporate any type of design indicia into the block design, such as depicted at 211 (depicted in exemplary and non-limiting fashion as either a professional or college sports logo applied to top surface of selected walkway step 212) and at 213 and 215 (further depicted as name and street address indicia applied to vertical riser locations of blocks 212 and 210, respectively). The design indicia schemes can be molded into one or more blocks during their original casting, this further including the possibility of inserting a temporary and customized template or pattern (not shown) into a receiving inside location of the corresponding block producing die, with the particular customer name/address and any additional desired indicia patterns exhibited in the template, pattern or form for placement into a pocket or other receiving location associated with one or more of the step or walkway surface defining molds or dies used for creating the blocks (thus avoiding having to reconfigure the die of the block to exhibit a given desired design indicia). This can further include the inside of the die exhibiting one or more removable blocks which can be substituted by the three dimensional and insertable template, pattern or form exhibiting the desired indicia pattern on its inside face. Without limitation, it is also understood that the mold or die itself can be modified for creating any significant number of the blocks with a given standard design indicia, and can also be reconfigured or modified to any other extent desired in order to provide any customizable pattern or scheme.

Figure 33:
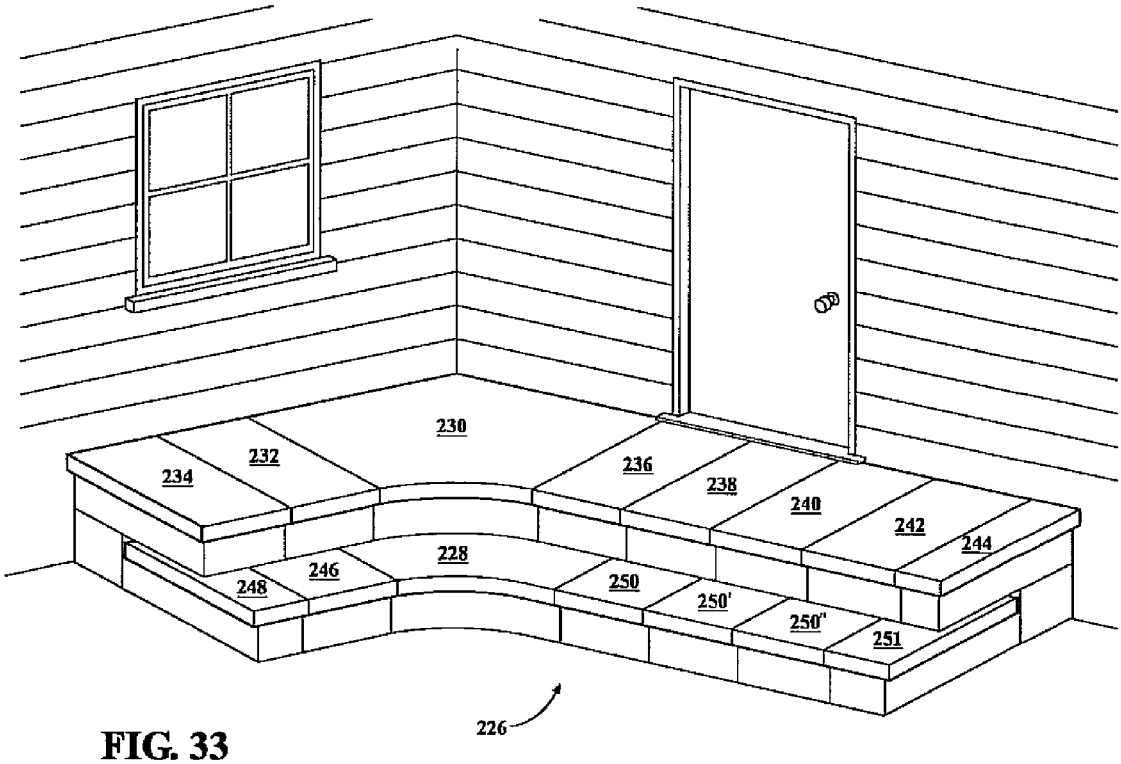
FIG. 33 is a perspective view of a yet further variant of an inside corner block assembly defining a combined porch and step.

FIG. 33 is a perspective view of a yet further variant, generally at 226, of an inside corner block assembly defining a combined porch and step. This includes arcuate and inner corner stacked components 228 and 230, with additional upper elongate defining components 232-244. Corresponding lower components include an intermediate left hand located block 246 and end most located block 248 (located in a stacking arrangement underneath upper tier left hand block 234. Additional located blocks associated with the lowermost row include intermediate right side located blocks 250, 250' and 250", as well as a right hand located end block 251 (located in stacking arrangement underneath right hand upper tier end block 244) and defining one possible stacking arrangement. Without limitation, one possible arrangement can include the blocks each weighing from about forty to one hundred and twenty pounds and exhibiting front dimensions of 12"×30" in size, excluding the top level cap blocks.

Figure 34:
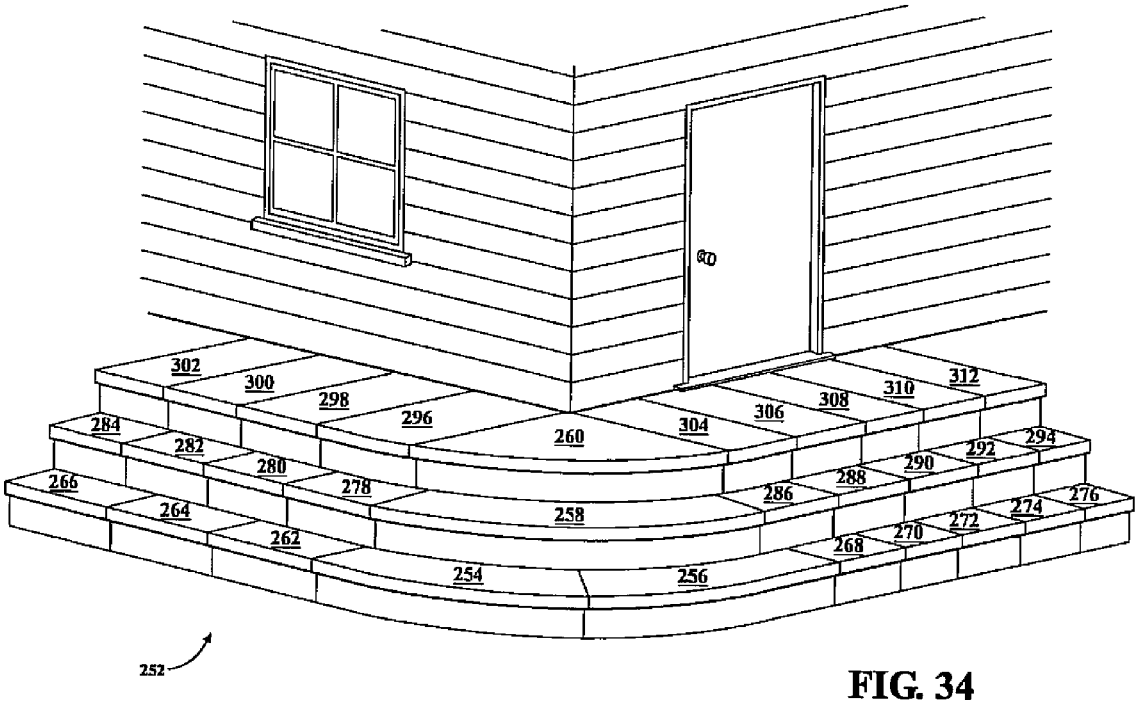
FIG. 34 is a succeeding view of an outside corner block assembly.

FIG. 34 is a succeeding view of an outside corner block assembly, generally at 252 and including outer corner arcuate extending and stacked levels 254 & 256 (bottom-most), 258 (intermediate) and 260 (upper). Additional elongate defining pluralities of blocks include those shown at 262-266 extending from outer edge corner block 254 and further at 268-276 extending from outer edge of corner block 256. Corresponding intermediate level blocks are arranged in similar and elongate extending fashion from opposite sides of the corner block 258 and are shown at 278-284 and 286-294. Upper level blocks likewise extending in elongate defining fashion from uppermost corner block 260 are further depicted at 296-302 and 304-312 in one non-limiting arrangement.

Figure 35A:
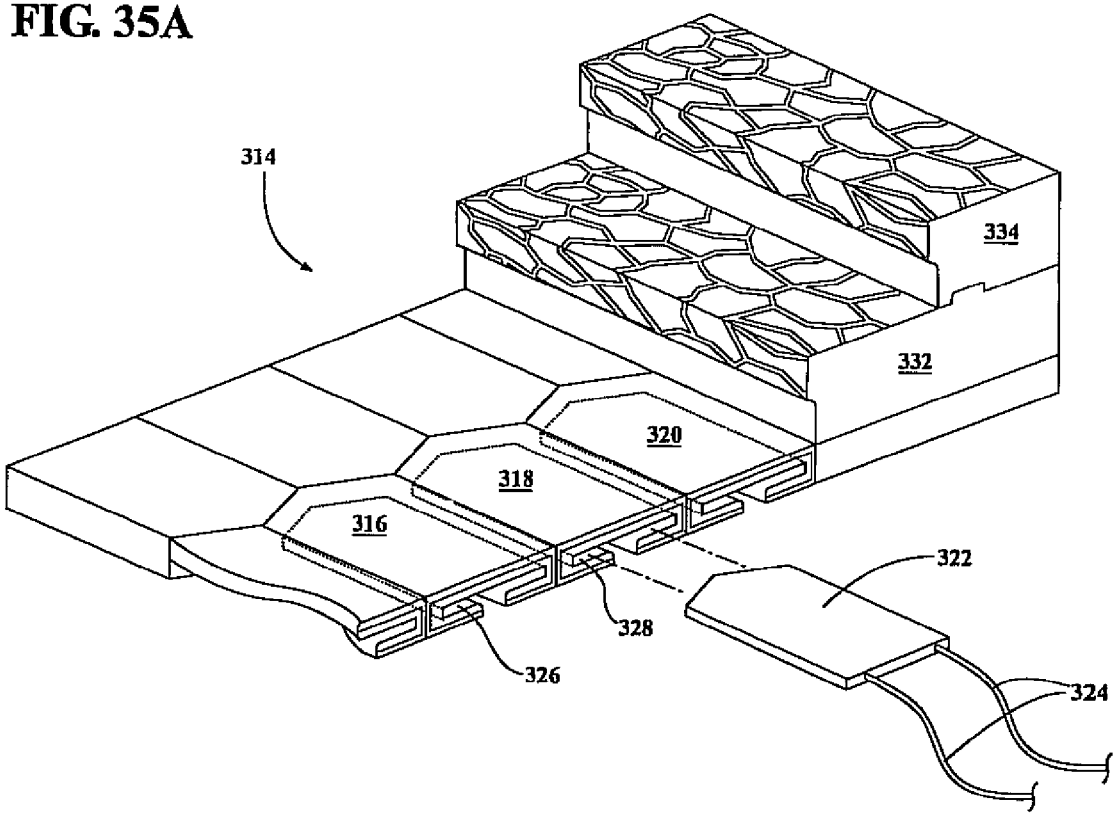
FIG. 35A is an illustration of a walkway path constructed of a plurality of precast construction blocks in the shape of interlocking patio pads and including heat generating pads installable within pockets defined within each block.

FIG. 35A is an illustration is generally shown at 314 of a walkway path constructed of a plurality of precast construction blocks, at 316, 318, 320 et seq., in the shape of interlocking patio pads and including heat generating pads (for example depicting a thin wafer like shape at 322 with extending wiring, see pair of leads 324 which can again be arranged in a daisy chain or like desired arrangement in order to provide series connection of a plurality of heating pads). As in previous embodiments, the pads are installed within pockets, at 326, 328, 330, et seq., defined within side accessible locations of each block 316, 318, 320 et seq.

By this construction, a sidewalk or pathway component can be created which matches the construction and features of the vertical step assembly (see further blocks 332 and 334). The stepping stone configured elements 316, 318, 320 et seq. can be likewise individually pre-cast and can also incorporate additional lighting or other effects without limitation, with the heating pads 322 (such as which are again constructed in order to be accessible and replaceable on an as-needed basis without adversely affecting the pre-cast construction of the various blocks) seating within the depicted pocket recesses associated with any number of stepping or walkway locations as depicted and in order to assist with melting of snow and ice. As with the LED elements, a thermostat controller can control the activation and deactivation of the heating pads, such in one non-limiting example in a cycling (on/off) fashion over a given time interval to maintain a clear walkway or step location and without unnecessary expenditure of power.

Figure 35B:
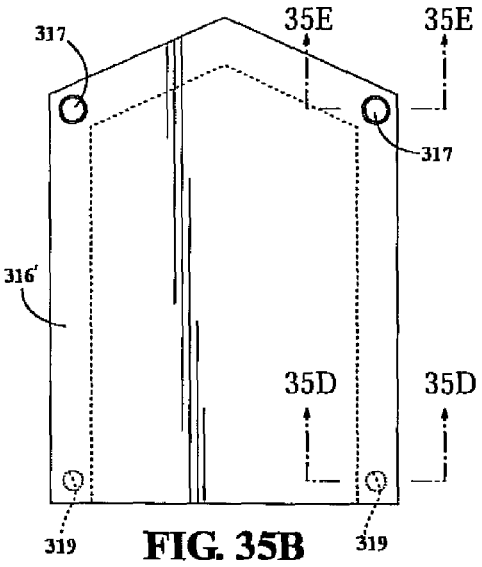
FIG. 35B is a top view of a selected walkway defining block illustrating in phantom an insertable pad in combination with a plurality of (4) corner defined lighting elements.
Figure 35C:
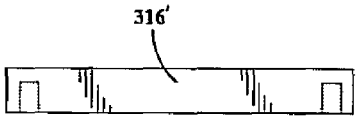
FIG. 35C is an end view similar to that shown in FIG. 35C of a selected walkway defining block with spaced apart precast lighting element pockets.

FIG. 35B is a top view of selected walkway defining block 316' and illustrating in phantom an insertable pad (such as previously shown at 322) in combination with a plurality of (4) corner defined lighting elements, further shown representatively at 317. FIG. 35C is an end view similar to that shown in FIG. 35B of selected walkway defining block 316' with spaced apart precast lighting element pockets (see further FIG. 35D) within which the LED or other lighting elements can be installed.

Figure 35D:
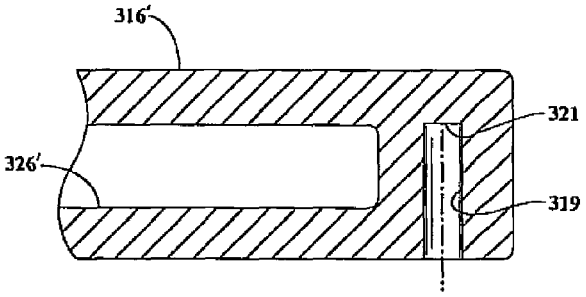
FIG. 35D is a partial side depiction in cutaway at 35D-35D of FIG. 35B of a selected walkway construction block and which depicts a pre-cast pocket defined in the underside of the block for eventually receiving a top surface directed lighting element.
Figure 35E:
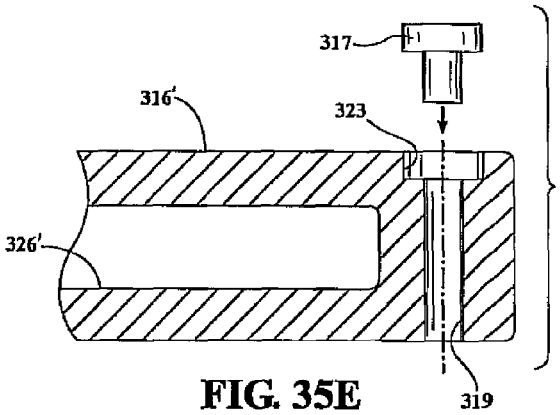
FIG. 35E is an illustration similar to that shown in FIG. 35B and depicting a finishing top surface drilling of an increased diameter portion facilitates top surface seating of the LED or other desired lighting element.

FIG. 35D is a partial side depiction of a selected walkway construction block 316' previously referenced in FIGS. 35B and 35C, which depicts (at cutaway 35B-35B of FIG. 35B) a pre-cast pocket associated with a selected lighting element 317, the pocket being defined in the underside of the block and depicted in exemplary outline by annular side wall 319 and underside recessed end wall 321. FIG. 35C is an illustration similar to that shown in FIG. 35B (such as of a further selected lighting element 317 and depicting a finishing top surface drilling (or drill out) of an increased diameter portion (see at 323) which facilitates top surface seating of the LED or other desired lighting element 317, again depicted in general and non-limiting fashion for seating within the horizontal top surface of the walkway or other defining block. In this manner, the step or walkway blocks can be casted to exhibit any configuration of underside recesses or pockets, and which are easily customizable by drilling out surface accessing portions to facilitate quick install of suitable lighting elements and any needed wiring so as to quickly customize the block to depict any lighting scheme. As is also clear from the depictions of FIGS. 35B-35#, the lateral dimensions of the pockets (as exemplary shown at 326' and compared to at 326 in FIG. 35A) can be reduced to provide adequate material along the sides and edges of the horizontal surface of the block in order to facilitate mounting of the LED elements in the manner shown.

Figure 36:
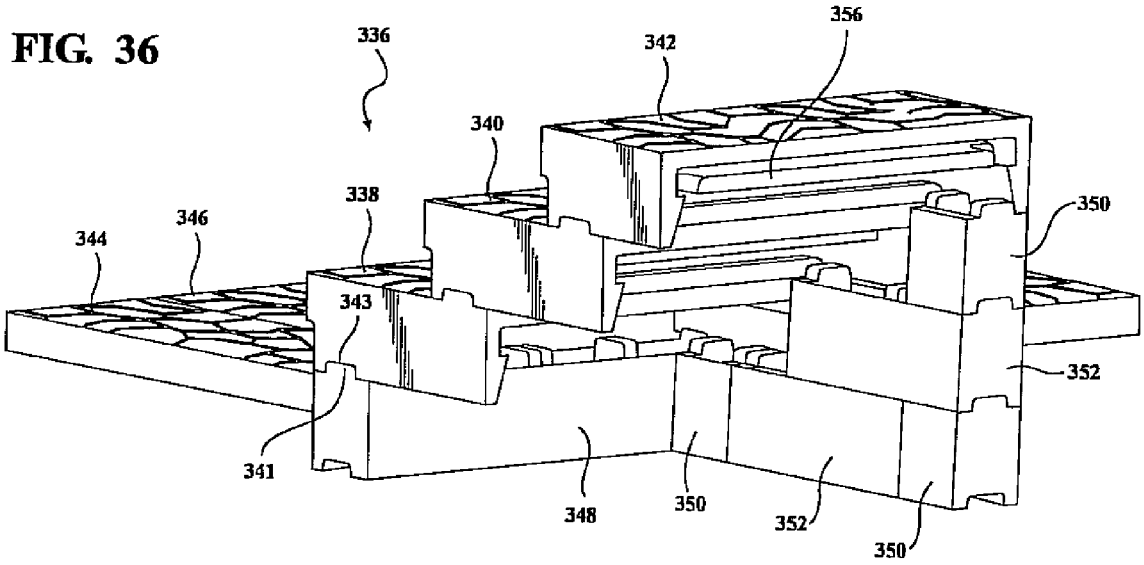
FIG. 36 is a rear perspective of a multi-tier assembly according to a further variant and which a shelf, such as containing any type of heat generating pad or insert, is provided in installed fashion within any one or more of a plurality of step blocks arranged according to any successive stacked or tiered fashion.

Referring now to FIG. 36, a rear (back side) perspective is generally shown at 336 of a multi-tier assembly according to a further variant which incorporates a combination walkway and stepped assembly with horizontally tiered steps, see at 338, 340, 342, this in combination with ground located and extending walkway portions or stones, at 344, 346, et seq. Also depicted are pluralities of support blocks 348, 350, 352, et seq., each of which illustrate a generally rectangular three dimensional shape and exhibit tongue and groove profiles on upper and lower surfaces, and which are assembled in supporting fashion underneath the tiered steps 338, 340, 342 in the manner depicted.

With further reference to the succeeding illustrations, both the steps and support blocks provide a desired tongue and groove interlocking relationship (see by example tongue 341 in support block 348 which seats within underside groove 343 of lowermost positioned step 338) in order to facilitate assembly according to any of a number of modifiable configurations. As further previously described, volumes of a weighted and compactible in-fill material, such as gravel, pea stone or the like, can be employed in order to establish a secure grade support for the top surface of the lower most tier of support blocks and walkway stones, with additional volumes of compactible material providing weighted support to the interior volumes of each stacked step or support block, as well as in-filling the interior volume defined between and underneath the shelves and supporting blocks.

Further shown are either of electrical or fluid based heating units, referenced in this series of illustrations as a shelf depicted at 356 in FIG. 36. The shelves 356 each exhibit a thin planar and rectangular profile which, in one non-limiting application, creates a pocket for accepting a suitable heating element (such as again shown by the thin and planar heat generating pads previously depicted in FIGS. 21-23 in the preceding described embodiments). As will be further described in additional detail, the heating pad or element containing shelves are adapted to being installed through a rear open profile of each indicated step block, e. g. at 342, which in turn exhibits an interior and upper inside ledge for supporting the shelf 356 (this in contrast to the thin insertion slot depicted in the side profile of the selected walkway casted stepping blocks shown in FIGS. 21-23 and 35).

As further shown in FIGS. 36 et seq., the interior defined ledges in the open rear of the step blocks (see as further described in FIGS. 45-48) are in proximity to the upper horizontal surface of the step blocks (such as with or without the use of an adhesive) and to permit the heat generated from the shelf 356 to be conducted through the material of the step and to emanate from the upper surface to facilitate ice/snow melt-off. As previously described, the heat (or cool) generating shelves and associated steps (or step blocks) are constructed so that the shelves can be easily retrieved and replaced (such as upon them burning out or otherwise failing to properly operate), this again capable of being accomplished without damaging the pre-cast block construction defined by the shelves and other interlocking components.

As with the previous variants, each step block or support block can be constructed of any silicate based or other material, such as including a composite material incorporating any one or more of a silicate ingredient, an expandable foam, an entrained aggregate and/or any additional polymeric, ceramic or metallic ingredient. Although not shown, the steps and blocks are each produced in a suitable mold process using a desired application of heat and pressure and within which the desired recipe mixture of ingredients can be pre-deposited or applied in an injection molding process.

Also depicted on an upper surface of each step block and walkway portion or stone is a decorative pattern which again can be formed into the component during molding (such as being integrated into the upper horizontal and vertical interior surfaces of the cavity). Also not also shown is the ability to employ variations of color or pigmentation into the production of the shelves and walkway stones, this including modifying the recipe mixture and/or the manner of delivering to the mold, such as in a localized manner in relation to the exposed surfaces and in order to provide the finished article with a desired visual appearance without unnecessary waste of materials.

Figure 37:
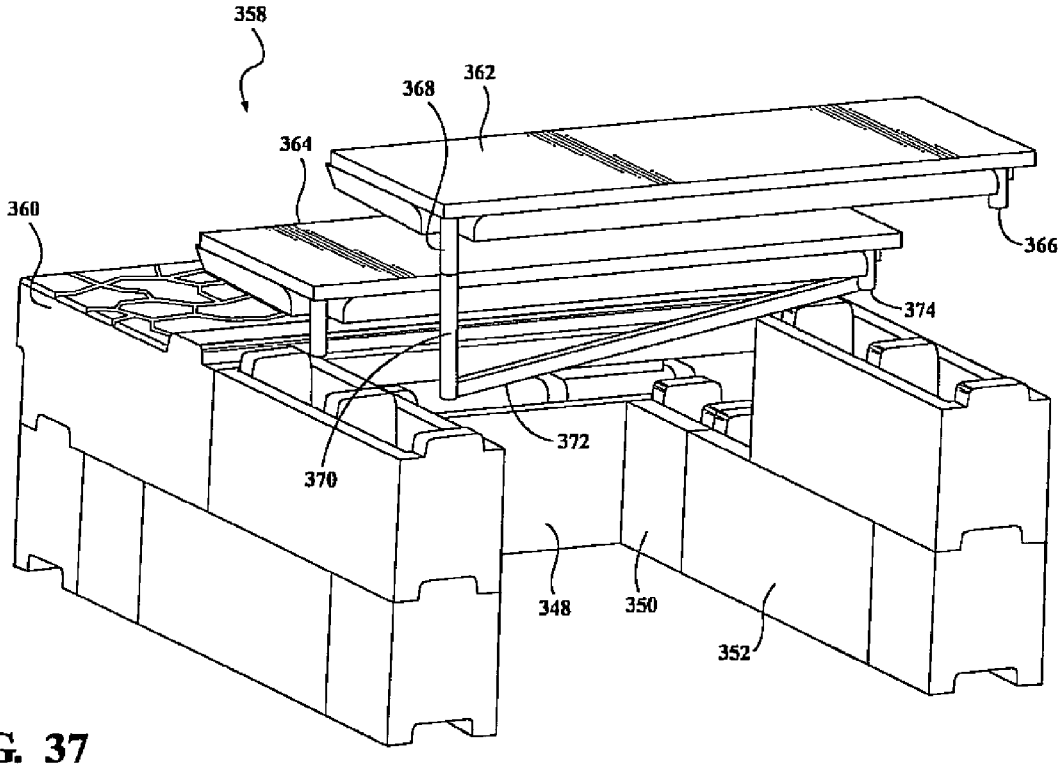
FIG. 37 is a further rotated and modified view of an assembly similar to FIG. 36 and in which a fluid heating variant of tiered heating support block is depicted in which conduit feeds the heated fluid through the support blocks via opposite end located inlet and outlet ports.

FIG. 37 is a further rotated and modified view of an assembly, generally at 358, which is similar to FIG. 36 with support blocks as previously depicted at 348, 350, 352, et seq. The electrical version of the heating shelves (see again at 356 in FIG. 36 and which can again include either an integrally formed inner pad element or an insertable pad such as depicted in the preceding embodiments), is in this variant substituted by coolant circulating jackets representatively shown at 362 and 364, with the associated step blocks not being shown for purposes of clarity of illustration.

The fluid communicating jackets are similarly configured in a daisy-chain series arrangement, with an upper most jacket 364 exhibiting an inlet 366 (to which is connected a fluid conduit not shown). The coolant (also not shown) is communicated through a piping network integrated throughout the interior of the planar shaped jacket 362, prior to being outputted through an outlet 368. A conduit (see angled sections 370 and 372) redirects the fluid from the first jacket outlet to a further inlet location, at 374, of the lower tier succeeding shelf 364, with the conduit transferring heated fluid through any number of successive shelves, following which a return line can be installed for returning the fluid to a source location for reheating (such as within a solar powered collector, a geothermal fuel pump or other conventional gas fired equipment not shown) and prior to being recirculated.

Not further shown is any suitable pump or other Venturi effect closed loop fluid system for ensuring constant fluid flow through any number of interconnected fluid jackets. It is also envisioned and understood that such a geo-heating system could also be reconfigured in order to cool the shelves/steps and stepping stones, such being desirable in very hot climates in which melting of snow and ice is not a concern however in which providing for a temperate walkway surface is very desirable. Such an application would envision liberal use of solar panel technology with appropriate heat transfer condenser/chiller equipment in order to provide a cooled glycol or other like water based solution (and as opposed to heated) in order to cool the steps and pathway.

Figure 38:
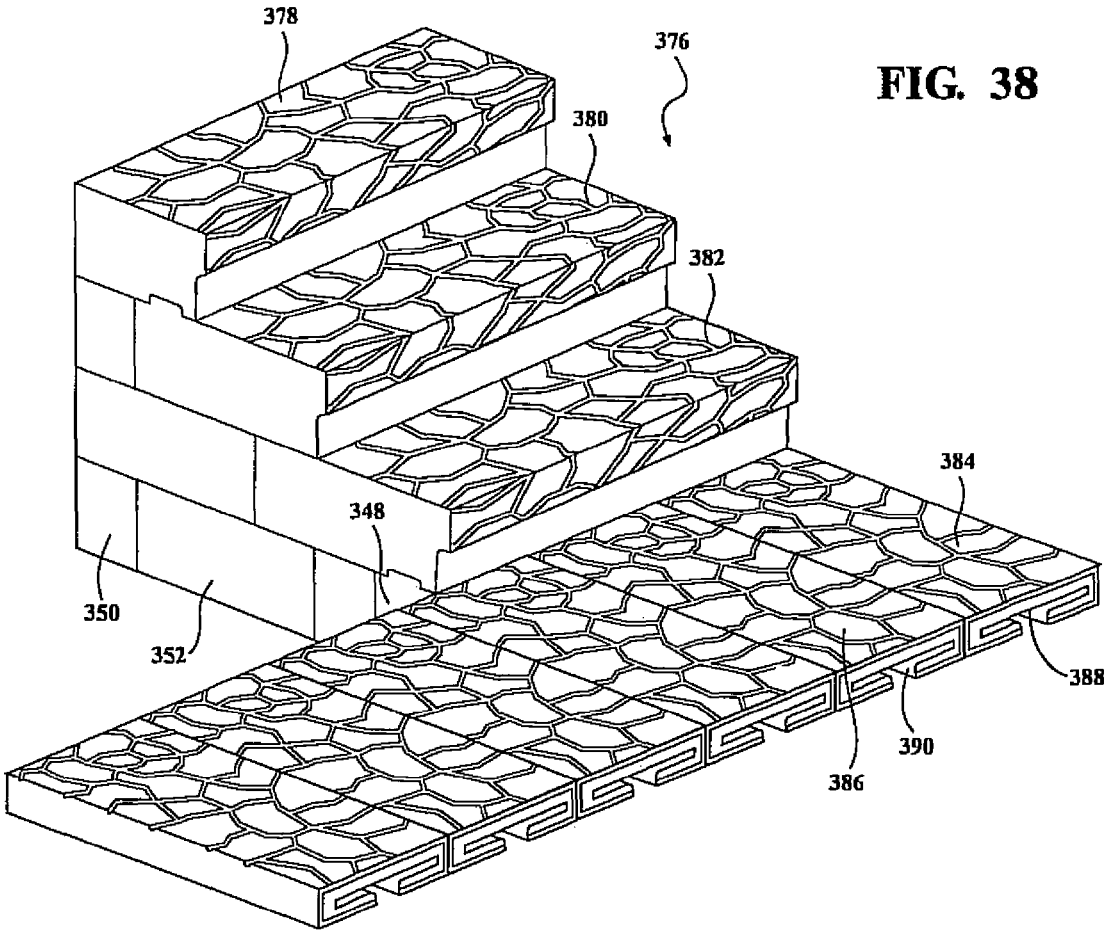
FIG. 38 is a perspective of a further assembly including tiered step section with decorative stamped or other exteriorly configured design associated with each block, in combination with a walkway portion illustrating side inserting apertures for receiving electric heating pads.

FIG. 38 is an illustration generally at 376 is a perspective of a further assembly including tiered step sections or step blocks 378, 380 and 382, along with decorative stamped or other exteriorly configured design associated with each shelf or block, and in combination with a walkway portion provided by additional ground located stones or other cast or molded portions 384, 386, et seq. The ground located portions defining the walkway surface further illustrate side inserting apertures, see at 388 and 390 for selected portions 384 and 386 respectively, these being configured for receiving in width inserting fashion such as electric heating pads (not shown) of a type previously described.

Also depicted are examples of support blocks 348, 350, 352, et seq. which are assembled in tongue and groove fashion along with the tiered step blocks 378, 380 and 382 to create a durable construction. A surfacing pattern is again exhibited for each of the steps or step blocks and stepping stones/walkway portions in a manner consistent with that previously described and which can include the provision of any desired coloring/pigmentation which can provide a desired visual effect to the completed assembly.

Figure 39:
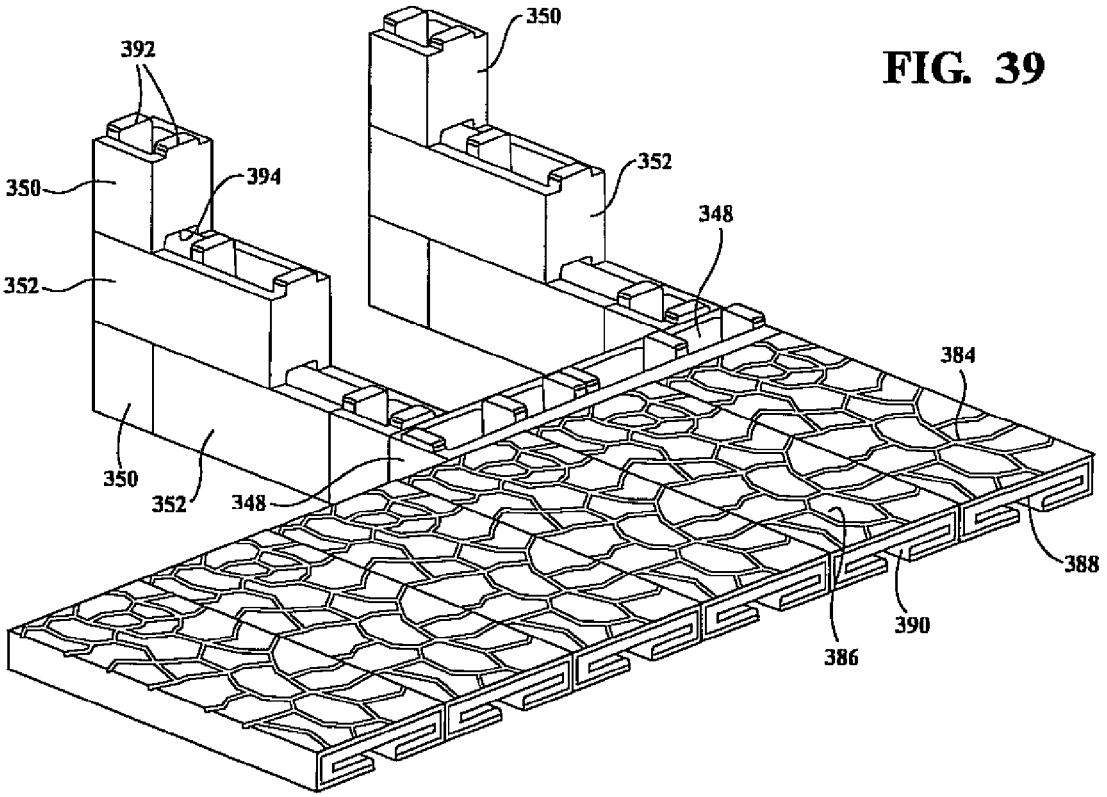
FIG. 39 is a similar illustration to FIG. 38, with the tiered steps removed and in order to further illustrate the initial layer of support blocks, such as which are assembled upon and into the earth or ground location in order to array a top extending surface thereof level or flush to a grade surface, the associated walkway surface again depicting apertures for receiving heating elements to facilitate the melting of snow and ice.

FIG. 39 is a similar illustration to FIG. 38, with the tiered steps/step blocks 378, 380 and 382 removed, and in order to further illustrate the initial layer of support blocks 348, 350, 352, et seq., such as which are assembled upon and into the earth or ground location in order to array a top extending surface thereof level or flush to a grade surface, the associated walkway surface again depicting apertures for receiving heating elements to facilitate the melting of snow and ice. Also better shown is the arrangement of tongue and groove portions associated with each of upper and lower surfaces of each supporting block, and as exemplary shown in reference to selected support block 350 with upper tongue 392 and lower groove (recess) 394 for engaging a corresponding tongue associated with an underneath located block 352.

Figure 40:
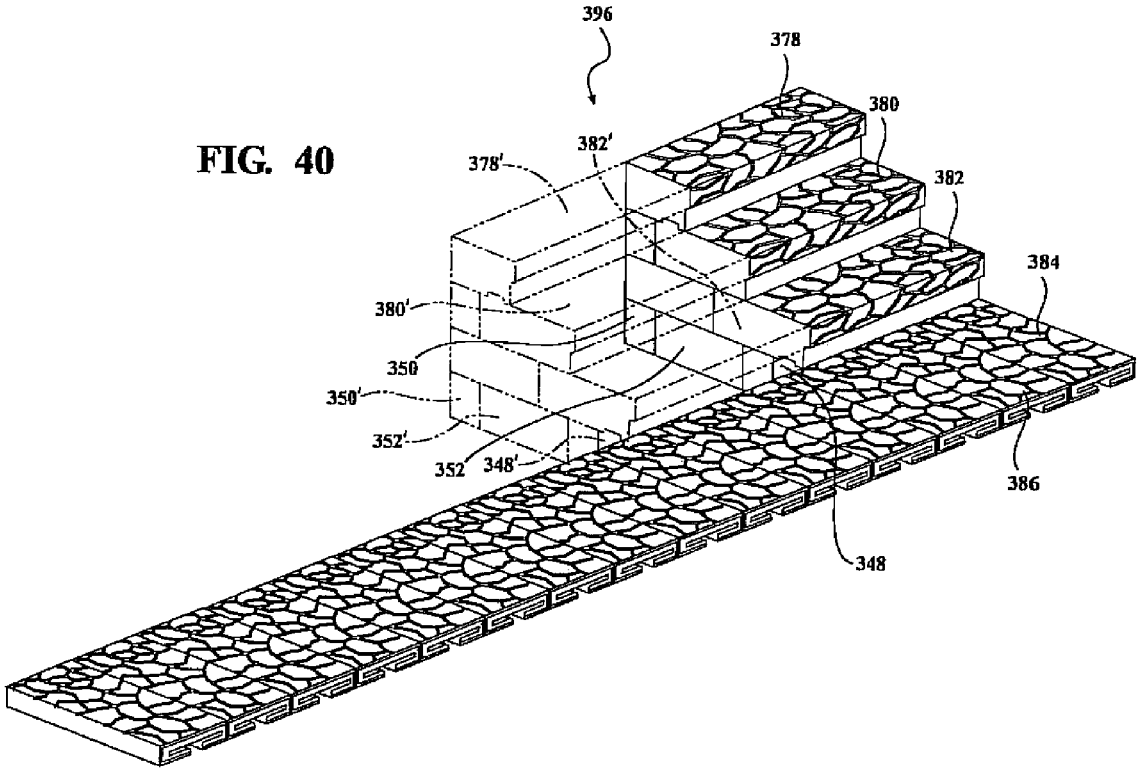
FIG. 40 is an illustration of a further variant of a stackable assembly including a plurality of tiered steps, supporting blocks and stepping stones.

FIG. 40 is an illustration of a further variant of a stackable assembly, generally at 396, and which largely repeats that previously described including a plurality of tiered steps 378, 380, 382, supporting blocks (again at 348, 350 and 52) and stepping stones 384, 386, et seq. The illustration of FIG. 40 is meant to demonstrate the variability of the assembly in terms of scalability and which can include a second scaled combination of steps 378', 380' and 382', with corresponding support blocks 348', 350', 352' et seq., such as which are assembled alongside the first stepped arrangement and which further demonstrate the reconfigure-ability of the present invention. Although not shown, additional variants can contemplate the stepping stones being reconfigured as ramps or the like to accommodate such as wheelchairs and the like.

Figure 41:
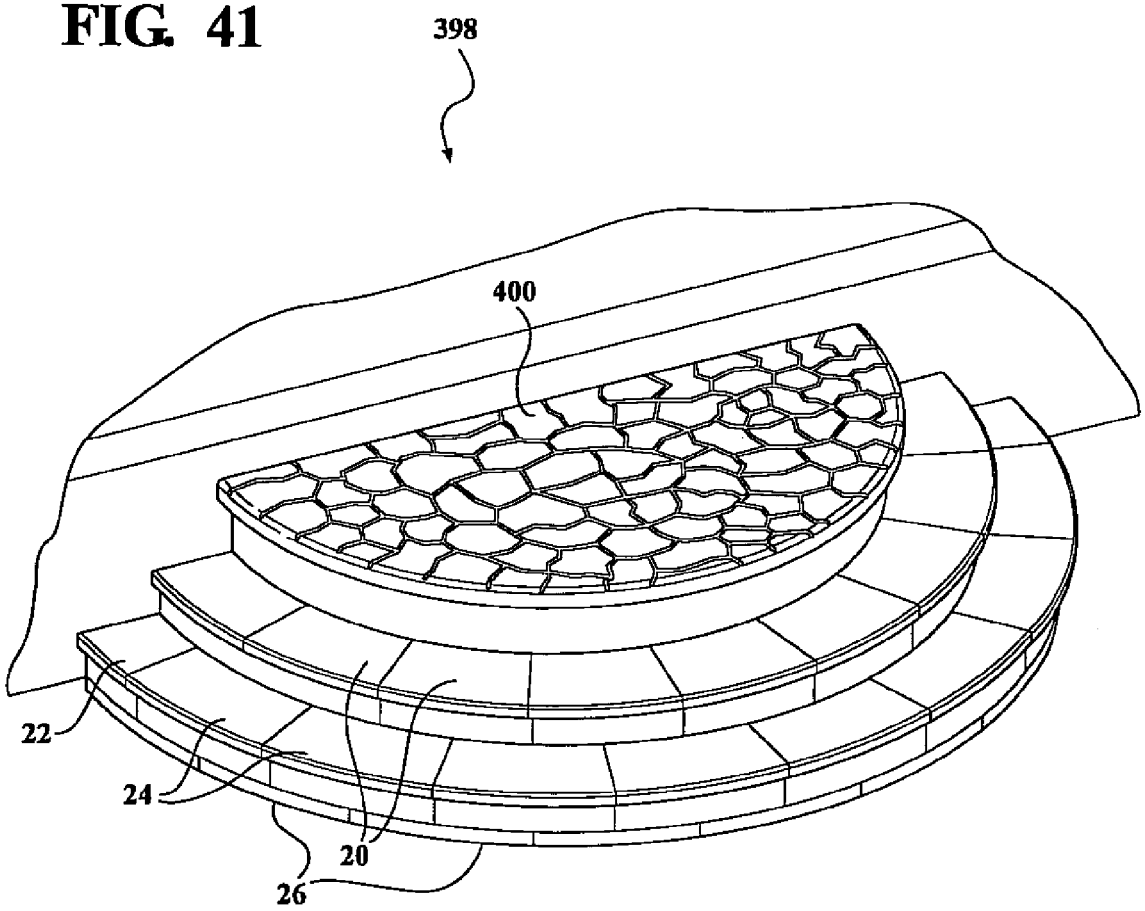
FIG. 41 is a perspective view of a further variant of assembled step construction similar to that originally disclosed in FIG. 1 and depicting a pre-cast decorated upper platform surface.

FIG. 41 is a perspective view of a further variant of assembled step construction, generally at 398, and similar to that originally disclosed in FIG. 1 and depicting a pre-cast decorated upper platform surface 400 (such as exhibiting a desired exterior pattern consistent with previously described variants). For purposes of ease of description, the lower tier blocks associated with the assembly 398 and include such as those previously disclosed in the initial variant of FIG. 1 with grade level blocks 26, second tier blocks 24 and third tier blocks 20 only in combination with the upper tier pad 400 (as compared to at 12 in FIG. 1). Otherwise, the present invention contemplates any assembly which can be assembled or reconfigured, redesigned or reassembled in any fashion desired to create an attractive porch, stairway or walkway location.

Figure 42:
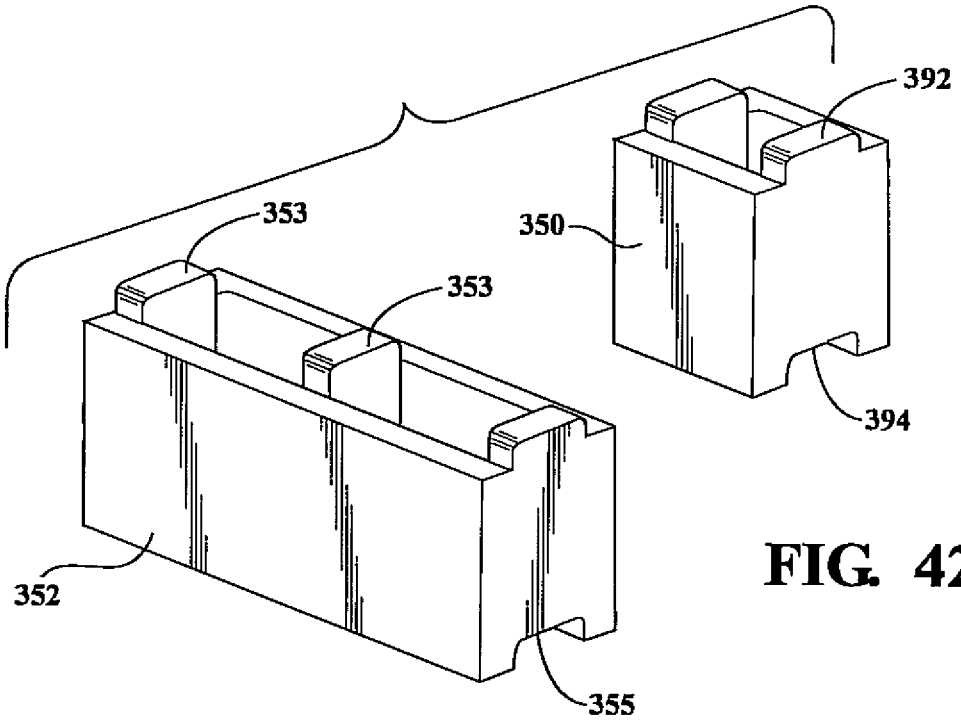
FIG. 42 is an assembly view of a pair of support blocks forming a portion of the assembly shown in FIG. 36 and illustrating mating tongue and groove profiles to facilitate tier supporting stackability.
Figure 43:
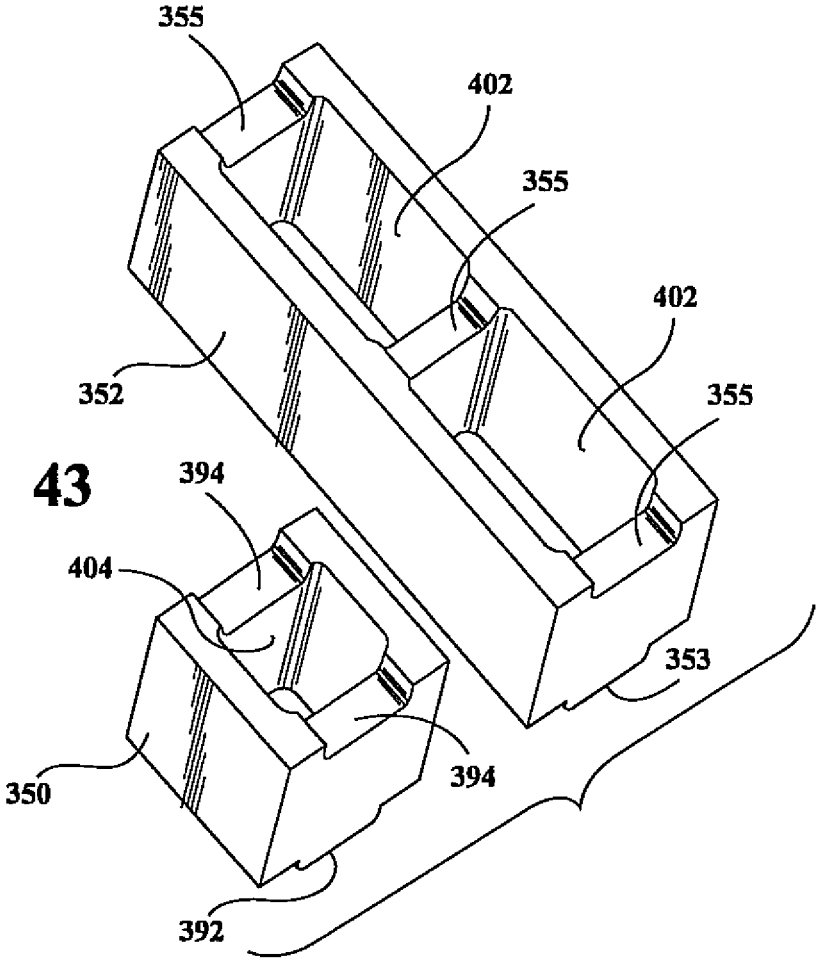
FIG. 43 is a further illustration of the blocks in FIG. 42 in a rotated underside looking view.

FIGS. 42 and 43 provide a pair rotated perspective views of support blocks, again at 350 and 352, and forming a portion of the assembly shown in FIG. 36. These again illustrate mating tongue and groove profiles (see at 392 and 394 as previously described for selected block 350 as well as at 353 and 355 for selected block 352) to facilitate tier supporting stackability. Without limitation, the support blocks can be reconfigured or redesigned, along with the tongue and groove configurations of the associated shelves such as previously depicted at 338, 340 and 342, and in order to ensure alignment of the steps or step blocks.

In one non-limiting application, the initial or support blocks 350, 352 can be constructed to fit any desired step size of 7" rise with 12" tread, with other potential sizes produced as desired. As further previously described, the rectangular shaped apertures associated with the interior of each support block (for example best shown in FIG. 43 by inner perimeter bound apertures 402 in block 352 and aperture 404 in block 350) provide the blocks with a desired weight savings during shipping and which can be in-filled on site and during construction with volumes of loose gravel, pea stone or other weighted and/or other compactible material in order to achieve the desired durability.

Figure 44:
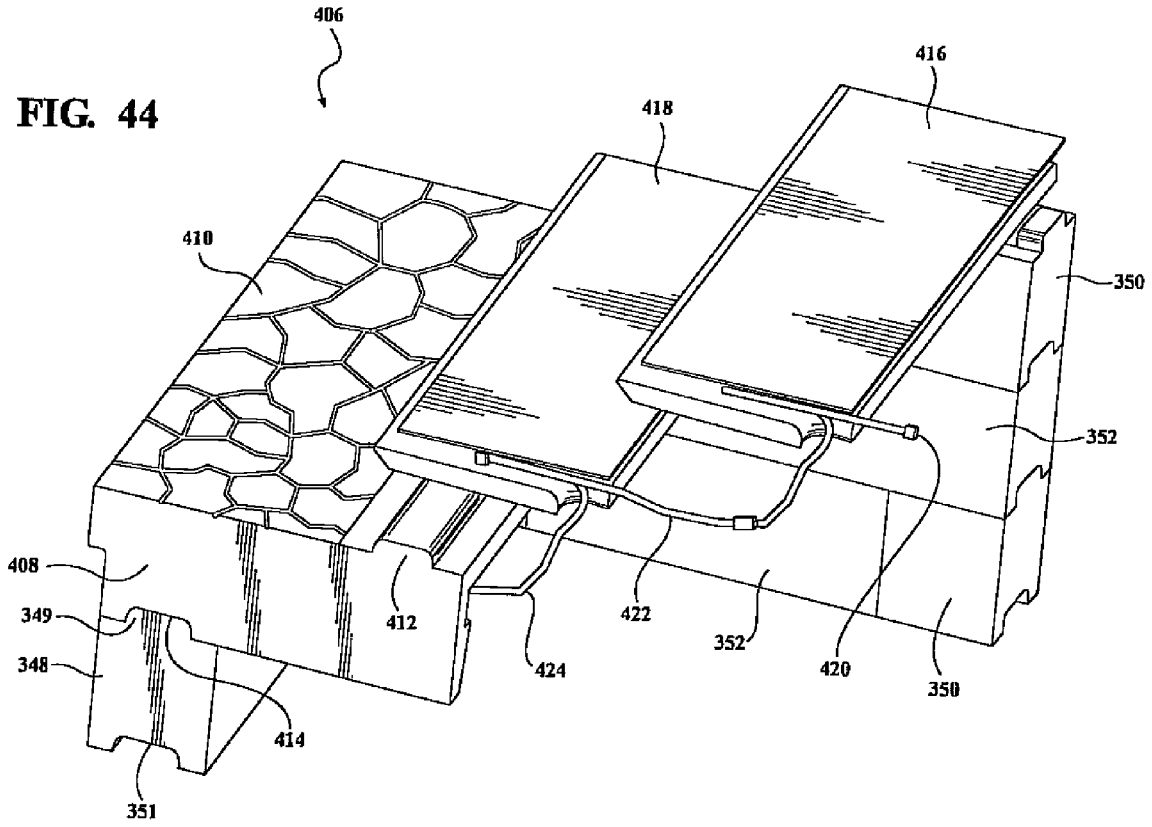
FIG. 44 is an illustration similar to FIG. 37 from a further rotated and cutaway perspective and showing a pair of step blocks with associated heating pads which are daisy chained together to permit a single power supply input to feed any plurality of the pads such as which can be arranged in chained or series communication.

FIG. 44 is an illustration of a further assembly, generally at 406, which is similar to the previous variant shown in FIG. 37, with FIG. 44 representing from a further rotated and cutaway perspective and showing a selected step block 408 (bottom tier) with representative underside supported block 348. The step block 408 is depicted in a manner consistent with that previously described and can include a decorative molded, casted, stamped or otherwise configured upper (at 410) and/or front exposed surface. Also depicted is an upper projection (or tongue) 412 which extends a width of the step block and which, in combination with a lower positioned groove 414, is capable of interlocking with the tongue and groove configuration of one or more succeeding step blocks and underside supporting blocks, as further again depicted by upper tongue 349 of selected block 348 along with lower groove 351.

A pair of heating step blocks with shelves are depicted at 416 and 418 and, in contrast to the fluid jacket constructed heating elements 362 and 364 in the preceding variant of FIG. 37, can include separate or integrally formed heating pads which are electrically communicated in a similar daisy chain arrangement so as to permit a single power supply input, at 420, to feed any plurality of shelve embedded pads arranged in chained or series communication, shown as additional wiring 422 leading to second shelf 418 and consecutive wire 424 leading to a third embedded shelf (not shown) associated with the step block 410 depicted. Without limitation, one example of a heating pad construction for facilitating conducted heat transfer to melt off snow and ice can include such an assembly as is sold under the commercial name "Snow Melting Mats" and produced by Heattrak®.

Proceeding to FIG. 45, a sectional perspective is shown of a selected step block 338 as previously described in FIG. 36 and which defines a selected tier defining block or shelf illustrating a top decorative surface. Additional features consistent with the previous description include a top extending tongue 345, lower extending groove 343, (see also rotated underside of FIG. 46). An interior ledge for receiving the electric or fluid communicating shelf is depicted by a three sided construction defined inside the open interior of the shelf 338 and which includes side supported edge profiles 426 and 428 and interconnecting front interior edge 430 (also FIG. 48), these collectively defining a three sided interior support in proximity to the inside top surface of the step block 383 (at 432 in FIG. 46). FIG. 48 is a side plan view of the shelf of FIG. 45 and disclosing in phantom the inner shelf supporting profile with inside forward ledge communicating with interconnecting side ledges shown in FIGS. 46-47, this in order to secure the inserted heat generating shelf according to any configuration previously described.

FIG. 49 is a perspective illustration of a heat generating shelf and as generally depicted at 434, according to one non-limiting configuration and which is installed in a rearward inserting fashion within the three sided ledge support as defined in FIGS. 46-48. In combination with the rotated underside of FIG. 50, the top plan view of FIG. 51, front plan view of FIG. 52 and, finally, side profile view of FIG. 53, the shelf 434 includes a generally planar construction with a top surface 436, a bottom surface 438, rearward inserting edge 440 and forward inserting edge 442. A pair of notched corner locations 444 and 446 separate the rear inserting edge 440 from opposite side edges 448 and 450 and, in construction, facilitate installation of the shelf 434 in a manner consistent with the similarly shaped pad or shelf shown at 356 in previous FIG. 36 installed within a similarly defined inner ledge profile associated with the selected ledge 342 in FIG. 36.

Figure 23:
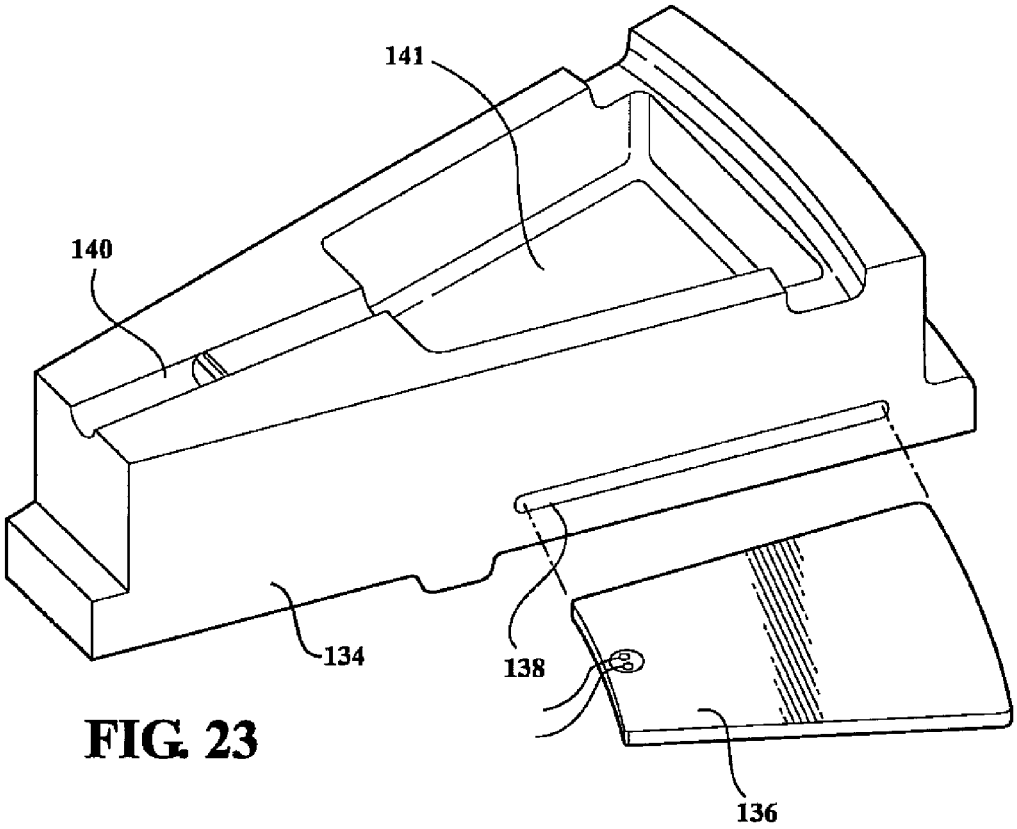
FIG. 23 is a rotated underside perspective view of the block shown in FIG. 22 and illustrating an alternate recess configuration with horizontal channel, as compared to that shown in FIG. 8, and in order to accommodate the positioning of the sideways installed heating pad.

The heating element employed can further, depending upon the attendant limitations of manufacturing, exhibit either the planar thin pad configuration such as previously shown in FIGS. 21-23, assuming the step block, walkway stone or the like can be produced with a suitably thin accessible pocket for receiving the thin profile pad. In other manufacturing assemblies, the feasibility of molding the concrete or mixed silaceous blocks (such as limiting the length of a long and thin cross sectional shaped tooling which can be retrieved from the forming concrete or mixed component block) may require the configuration of the inner ledge for receiving the shelf construction such as further shown in FIGS. 49-53.

In any non-limiting application, the blocks are capable of being pre-manufactured with or without the heating shelf or pad included. In the latter instance, any number of heating pads or shelves can be post installed during on site construction of the kit and based upon the configuration of the final assembly.

Having described my invention, other and additional preferred embodiments will become apparent to those skilled in the art to which it pertains. This can include incorporating an automated system with a controller (not dissimilar to that associated with a conventional sprinkler system) for operating either or both of the heating pad elements (such as in conjunction with a thermostat control with precipitation sensor) and/or the use of a separate light sensor for activating the effect lighting elements. Manual on/off controls would also be contemplated to be part of such as an assembly.

Additional aspects associated with the initial manufacture process include introduction of a control process for monitoring part to part variation (color, pattern, texture, and application of outer concrete sealer for environmental protection) this in addition to determining part shape or profile of each block. Additional kit assemblies can be integrated into the program for enabling the construction of a given assembly according to substantially pre-set length, width and height dimensions and in order to minimize the requirement for individual cutting or resizing of the blocks.

As previously described, the heating elements and/or effect lighting can be original installed with the assembly or can be subsequently retrofit installed with a minimum of disassembly and repeat application of any required sealant. The mold technology associated with the production of the varying blocks is further understood to be modified in order to preform the desired pockets for receiving the heating filaments or pads.

Other and additional features include the incorporation of a suitable process for creating, installing and ballasting the individual bodies in order to create a desired functional and decorative structure. This can include, at a minimum, the steps of producing a plurality of individual bodies in a suitable mold or other casting process, such including tongue and groove profiles on at least opposite upper and lower surfaces, providing a decorative pattern (such as during molding or casting) on at least one exterior surface of any body, and assembling the bodies according to at least one of a multi-tier or walkway extending construction.

Additional steps can include assembling an under-structure for supporting a plurality of tier defining and width extending shelves, the understructure provided by additional pluralities of rectangular blocks with additional tongue and groove profiles for stackability, as well as recessed profiles for facilitating of compactible or other aggregate material (gravel, pea stone, etc.). Other steps include configuring a three sided inner ledge within a rear accessible open interior of the shelf in order to support an insertable thermal conducting pad. At least one vertical riser or horizontal surface of a shelf or walkway body can further integrate receiving locations for installing effect lighting such as L.E.D. elements or the like. Other steps include providing the thermal generating pads with either of electrical or thermal fluid input, with plurality pads capable of being daisy-chain connected in plural fashion from a common input source.

Yet additional variants contemplate the kit construction creating a free standing unit or assembly and such as which may not be attached to a house or other structure. One benefit of this type of construction is that it permits creation of such a structure often without the need for building permits (in many jurisdictions).

Beyond that disclosed, other features will become apparent to those skilled in the art to which it pertains, and without deviating from the scope of the appended claims.

The invention claimed is:

1. A patio assembly, comprising:

at least one plurality of bodies which are inter-assembled to create a tier defining and supporting surface;

each of said bodies having an underside accessible cavity which is adapted to receive a ballasting material during installation upon a ground supporting location, each of said bodies incorporating an upper side accessible recessed cavity separated from said underside accessible cavity by an interior wall, an aperture communicating with said upper side accessible cavity and extending to the underside surface of each body in order to establish a communicating network throughout said assembly;

a lip extending upwardly from said interior wall; and each of said bodies further having an underside groove sized to matingly receive said lip of an underneath block to facilitate assemble-ability of pluralities of said blocks in multi-tier and offsetting fashion.

2. The invention as described in claim 1, further comprising said bodies being arranged in either of a side-by-side or vertically stacked fashion in order to create a desired structure.

3. The assembly as described in claim 1, further comprising a top pad resting upon an upper most tier defined plurality of blocks, notched locations being established at circumferentially offset underside locations of said top pad for seating said lips of an uppermost assembled tier of bodies, said communicating network of apertures defining an interior extending fluid drainage network to a grade level located drain tile.

4. The assembly as described in claim 3, further comprising a lowermost plurality of below grade supported subterranean blocks, each exhibiting an upper facing and open recessed interior with a forward edge extending protuberance for seating said underside grooves associated with an overlaying and tier defining plurality of bodies, a drainage aperture extending through each of said blocks and in communication with said communicating network of apertures.

5. The assembly as described in claim 1, said bodies each exhibiting a one-piece construction with a forward extending nose edge.

6. The assembly as described in claim 1, further comprising thermal generating elements installed within at least one or more of said bodies.

7. The assembly as described in claim 6, said thermal generating elements further comprising any of electrical resistant generating pads or fluid conduit conveying systems extending through and between said bodies.

8. The assembly as described in claim 6, further comprising pockets formed in side edges of said bodies, said thermal generating elements each further comprising thin profile heating pads inserting within said pockets, resistive heat generating lead wires extending to and from each of said pads.

9. The assembly as described in claim 1, further comprising effect lighting installed within any one or more of said bodies.

10. The assembly as described in claim 9, further comprising individual LED elements mounted within aperture locations defined in at least one of vertical riser locations of each tiered layer of bodies or horizontal surface location of each walkway defining body.

11. The assembly as described in claim 1, further comprising pre-forming a decorative pattern within at least one exterior facing surface of a selected body.

* * * * *